US012044423B2

(12) United States Patent
Dameno et al.

(10) Patent No.: US 12,044,423 B2
(45) Date of Patent: Jul. 23, 2024

(54) DEVICE AND METHOD FOR MONITORING HVAC AIR FILTER

(71) Applicants: STMICROELECTRONICS S.r.l., Agrate Brianza (IT); STMICROELECTRONICS, INC., Coppell, TX (US)

(72) Inventors: Matteo Dameno, Novara (IT); Mario Tesi, Cornaredo (IT); Marco Bianco, Cesano Boscone (IT); Mahesh Chowdhary, San Jose, CA (US); Michele Ferraina, Milan (IT)

(73) Assignees: STMICROELECTRONICS S.r.l., Agrate Brianza (IT); STMICROELECTRONICS, INC., Coppell, TX (US)

( * ) Notice: Subject to any disclaimer, the term of this patent is extended or adjusted under 35 U.S.C. 154(b) by 157 days.

(21) Appl. No.: 17/137,204

(22) Filed: Dec. 29, 2020

(65) Prior Publication Data

US 2021/0207833 A1 Jul. 8, 2021

Related U.S. Application Data

(60) Provisional application No. 62/958,156, filed on Jan. 7, 2020.

(51) Int. Cl.
*F24F 11/46* (2018.01)
*F24F 11/58* (2018.01)
(Continued)

(52) U.S. Cl.
CPC ..... *F24F 11/46* (2018.01); *F24F 11/58* (2018.01); *F24F 11/63* (2018.01); *F24F 2110/10* (2018.01); *F24F 2110/40* (2018.01)

(58) Field of Classification Search
CPC .. F24F 11/46; F24F 11/58; F24F 11/63; F24F 2110/10; F24F 2110/40; F24F 11/64; F24F 11/39
See application file for complete search history.

(56) References Cited

U.S. PATENT DOCUMENTS 4,695,817 A * 9/1987 Kurtz ..... G01L 19/0654 338/42
6,110,260 A * 8/2000 Kubokawa ..... B01D 46/10 96/414
(Continued)

FOREIGN PATENT DOCUMENTS

CN 109534450 B * 6/2022 ..... C02F 1/441

*Primary Examiner* — Thomas C Lee
*Assistant Examiner* — Anzuman Sharmin
(74) *Attorney, Agent, or Firm* — SEED IP LAW GROUP LLP

(57) ABSTRACT

The present disclosure is directed to an air filter sensor system that can monitor a status of a filter and provide information to a remote system regarding the filter's status. The system can receive, by a computing server via one or more computer networks and from each of a plurality of sensor assemblies coupled to a corresponding plurality of air filters, information indicative of filter contamination levels respectively associated with each corresponding air filter of the plurality of air filters. Each of the respective filter contamination levels being provided by one sensor assembly of the plurality of sensor assemblies based at least in part on a difference in detected air pressure between first and second sides of the corresponding air filter. The system tracks the respective filter contamination levels over a first period of time and determines, by the computing server and based at least in part on the tracking of the respective filter contamination levels, a schedule for one or more maintenance events associated with a first air filter of the plurality of air filters.

23 Claims, 9 Drawing Sheets

(51) Int. Cl.

| | |
|---|---|
| ***F24F 11/63*** | (2018.01) |
| ***F24F 110/10*** | (2018.01) |
| ***F24F 110/40*** | (2018.01) |

(56) References Cited

U.S. PATENT DOCUMENTS

| | | | | |
|---|---|---|---|---|
| 6,186,744 | B1 * | 2/2001 | Wolochuk | F04D 27/001 417/44.2 |
| 7,261,762 | B2 | 8/2007 | Kang et al. | |
| 2014/0290559 | A1 | 10/2014 | Jakop | |
| 2015/0052978 | A1 * | 2/2015 | Beier | B01D 46/0086 73/38 |
| 2015/0254958 | A1 | 9/2015 | Sherman et al. | |
| 2016/0045854 | A1 | 2/2016 | Hung et al. | |
| 2017/0222866 | A1 * | 8/2017 | Wang | H04L 67/12 |
| 2017/0351241 | A1 * | 12/2017 | Bowers | G05B 13/048 |
| 2018/0085700 | A1 * | 3/2018 | Sato | H05K 7/20181 |
| 2018/0299155 | A1 | 10/2018 | Walsh et al. | |
| 2019/0083917 | A1 * | 3/2019 | Najafi | F24F 13/20 |
| 2019/0145650 | A1 * | 5/2019 | Nayak | F24F 11/63 700/276 |
| 2019/0155805 | A1 * | 5/2019 | Kent, IV | G06F 16/24575 |
| 2019/0230029 | A1 * | 7/2019 | Eswara | H04L 45/48 |
| 2019/0310005 | A1 * | 10/2019 | Cluff | F25B 31/026 |
| 2021/0063038 | A1 * | 3/2021 | Song | G05B 15/02 |
| 2021/0071885 | A1 * | 3/2021 | Hutz | H04W 12/02 |
| 2022/0274045 | A1 * | 9/2022 | Salazar | B01D 46/12 |

* cited by examiner

DEVICE AND METHOD FOR MONITORING HVAC AIR FILTER

BACKGROUND

Technical Field

The present disclosure is directed to a device and method for monitoring a heating, ventilation, and air conditioning (HVAC) air filter.

Description of the Related Art

The World Health Organization (WHO) released a report on urban ambient air pollution, which stated that more than 80 percent of people living in urban areas are exposed to air quality levels exceeding the WHO limits. Air filtration technology will play a crucial role in reducing this percentage in the future.

Numerous industries and applications use air filters with various techniques for determining a status of the filter. Each filter can only provide proper functionality as long as it is undamaged and its pores remain unclogged. Different risks are associated with dirty and humid filters, which can be a breeding ground for mold and bacteria. Punctured filters can be outright dangerous in medical respiratory equipment. Clogged filters reduce performance of an HVAC system and can consume more energy than needed. Clogged filters could lead to an undersupply of air, substantial loss of energy efficiency, noisy fan operations, reduced filter performance, and, eventually, result in damage to the filter itself. Therefore, it's important to monitor the condition of a filter and replace it in due time.

Filters should be replaced regularly to ensure economical, safe, and adequate operation. The periodic inspection of air filters is both time consuming, expensive, and usually ineffective in detecting damage within a reasonable period. In most cases the air conditioning filters are located in places difficult to be reached by final users and their replacement is done by specialized personnel who, usually, after a predefined period of time from the installation schedules the replacement. In some cases, the filter might be clogged sooner than the prescribed replacement time, thereby reducing the efficiency of HVAC system. In other cases, a technician could throw away a filter that is still good or otherwise performing within an acceptable range.

BRIEF SUMMARY

The present disclosure is directed to an air filter sensor system that can monitor a status of a filter, collect relevant data, and provide information to a remote system regarding the filter's status. This could allow a filter maker or a building management company to define and fine tune a model for the filter based on collected data and statistics. For example, the model can predict when a technician visits the filter based on the current and historical performance of the filter within the HVAC system. As such, the technician will replace the filter only when the filter is below an established performance threshold as opposed to a rigid schedule, unrelated to the actual status of the filter.

The present disclosure is directed to tracking performance of one or many air filters in a single building, a complex of buildings, an airplane, a vehicle, or any other space having air filters and HVAC type systems. By tracking the performance of each filter in real-time or at some periodic interval each air filter can be used fully and air filters with issues can be more quickly identified. Other features can include a self-tuning HVAC system that reacts to the changing conditions of each air filter and the environment, adjust in real-time to system performance with algorithm updates, monitoring each filter through periodic data analysis, post processing, and modeling. In addition to collecting pressure change from a first sensor to a second sensor attached to each filter, the system can collect temperature, humidity, air quality, and contamination level.

BRIEF DESCRIPTION OF THE SEVERAL VIEWS OF THE DRAWINGS

For a better understanding of the embodiments, reference will now be made by way of example to the accompanying drawings. In the drawings, identical reference numbers identify similar elements or acts. The sizes and relative positions of elements in the drawings are not necessarily drawn to scale. For example, some of these elements may be enlarged and positioned to improve drawing legibility.

DETAILED DESCRIPTION

Figure 1:
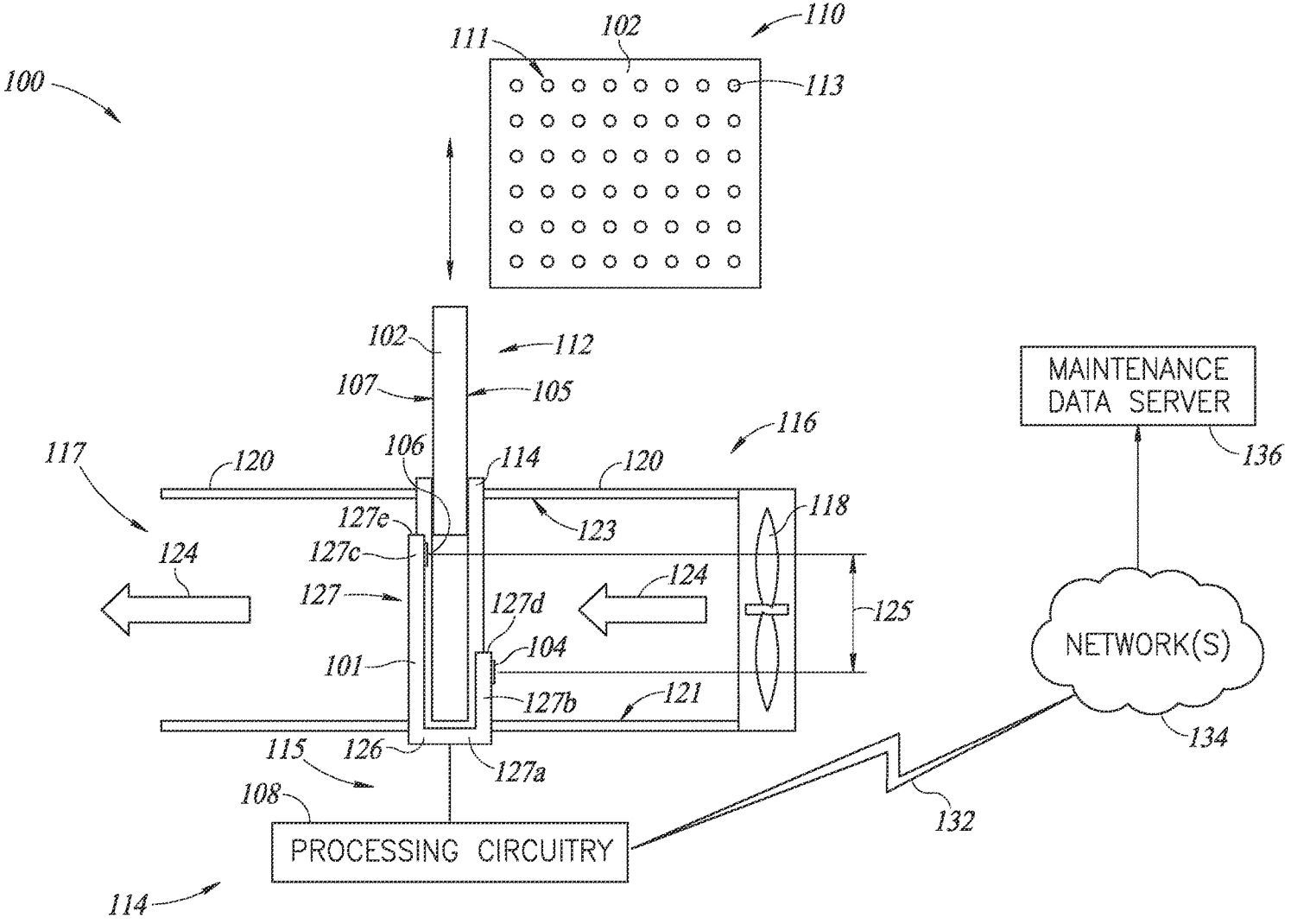
FIG. 1 is a system diagram of an embodiment of an air filter monitoring system utilizing an air filter sensor assembly.

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures or methods associated with air filters and sensors have not been shown or described in detail to avoid unnecessarily obscuring descriptions of the embodiments.

Unless the context indicates otherwise, throughout the specification and claims which follow, the word "comprise" and variations thereof, such as, "comprises" and "comprising" are to be construed in an open, inclusive sense that is as "including, but not limited to." Further, the terms "first,"

"second," and similar indicators of the sequence are to be construed as interchangeable unless the context clearly dictates otherwise.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is, as meaning "and/or" unless the content clearly dictates otherwise.

The present disclosure is directed to real-time monitoring of air filters for contamination or clogging. Currently air filters are monitored by manual tracking based on time of operation rather than on quality or performance of each individual air filter. Technicians schedule time to revisit an air filter immediately after they have replaced a current one. This is a very imprecise and human-limited way to monitor whether an air filter is still performing effectively. When air filters are clogged or contaminated they decrease HVAC system efficiency. There are health implications with underperforming air filters. In addition, the effectiveness (noise and overall performances) is impacted by air filters not operating within their threshold of effectiveness.

The present disclosure is directed to quickly identifying damage, such as a clog that reduces an air flow through an air filter or some other type of blockage to increase or improve performance of heating, ventilation, and air conditioning (HVAC) systems. These improvements will create specific efficiencies for each air filter and will create building or HVAC system level efficiencies, saving electricity and money for the system owner. For example, many HVAC systems will include more than one air filter, such as in an office building, a shopping center, a hospital, a factory, or any other building or industrial complex with a plurality of air filters. Transportation vehicles, like cars, buses, trains, and automobiles are also options for integrating the embodiments of the present disclosure. Building owners or management teams expend significant time and money to maintain the air filters to achieve high performance of these HVAC systems. Current techniques are highly manual and highly scheduled based on rough estimates of an amount of time during which the filter may become clogged. The current techniques are not based on the specific performance of each air filter.

The present disclosure is directed to real-time or periodic monitoring of each individual air filter's performance, including monitoring of the system as a whole. For example, as data is collected from each of the air filters either in real time or periodically, such as weekly, monthly, etc., the data can be processed to determine which filters are becoming clogged or their performance is decreasing. The system can evaluate and notify a system administrator that filters that are all in a particular area have similar behaviors. For example, air filters near rooms that are closer to an entryway may become clogged more quickly as more debris is brought into the building as doors are regularly opened and closed.

The present disclosure is directed to scheduling filter replacement based on real-time or consistent monitoring of each filter's data to reduce maintenance costs and reduce waste associated with replacing filters that are still performing successfully. By fine-tuning the replacement schedule, unnecessary repeat visits to the same location may be avoided by technicians, saving on human costs as well.

With air filter assemblies of the present disclosure and the air filter monitoring system, air filter contamination and flow levels may be determined, normalized, and communicated to one or more remote maintenance servers, such as those operated by or otherwise associated with a maintenance data service, a cloud computing service, or other service provider. In various embodiments, the remote maintenance data server can store data regarding every air filter in one or more HVAC systems, can run data analysis on each air filter or on a specified HVAC system as a whole, and can identify underperforming air filters and/or HVAC systems for attention from a technician. For example, when an air filter is clogged a technician or user that monitors the HVAC system can be alerted, such as when a threshold of contamination or reduction in flow has been reached. In addition, by analyzing a stored history of contamination levels, the remote maintenance server can optimize the use of filters at a location and reduce the cost of delivery and installation of replacement filters.

FIG. 1 is an embodiment of an air filter monitoring system 100. The system includes an air filter 102 positioned within a ventilation duct, vent, or ventilation body 120. A pressure sensor assembly 101 is coupled to the air filter. The pressure sensor assembly may be an absolute pressure sensor or a differential pressure sensor (see FIG. 10). FIG. 1 includes the pressure sensor assembly including a first micro-electromechanical (MEMS) pressure sensor 104 positioned on a first side 105 of the air filter 102. A second MEMS pressure sensor 106 is positioned on a second side 107 of the air filter 102. Processing circuitry 108 is coupled to the first and second MEMS pressure sensors and may be included in single assembly or as a separate component.

The processing circuitry is configured to receive data from the first and second MEMS pressure sensor and from other components that may be included in the monitoring system, like a temperature sensor. The processing circuitry 108 is illustrated as being directly coupled to the first and second pressure sensors, i.e. within a close physical proximity to the first and second pressure sensors. At a minimum, the processing circuitry is a controller or data collection and transmission device coupled to the first and second pressure sensors to collect their data and transmit the data to a selected data processing location where application logic or more robust data processing is performed. The data processing may receive data from a plurality of air filters, compare the data received to a variety of thresholds and parameters to evaluate individual air filter performance and overall performance of the HVAC system.

This can be considered an evaluation of the health and efficiency of the HVAC system and each individual air filter. A good health rating for an air filter may correspond to threshold air flow through the air filter, as detected by the first and second pressure sensor. A poor health rating for an air filter may correspond to large pressure difference between the first and second pressure sensor, i.e. the filter is clogged so less air is passing through the filter. The health ratings per filter will be determined by threshold air flow or pressure differences. These thresholds can be set when the system is first installed. In addition, the thresholds can be automatically or manually adjusted over time as the system gathers data and behaviors of the HVAC system are collected, evaluated, and adjusted. The good and poor health ratings can be applied to each air filter and to regions of an HVAC system and to the system as a whole. Different threshold values will be provided or determined by the monitoring system to evaluate the different aspects and performances of the system and the system's sub-systems.

This data processing location may be adjacent to the vent 120 or alternatively, the data processing location can be a location that is separated or remote from the vent 120. For example, in one embodiment the processing circuitry may collect the data from the first and second pressure sensors in real-time or at a selected time period and transmit the data to a maintenance data server 136 that is not positioned within a same room or area of a building in which the vent 120 is located. The maintenance data server could be positioned within the same building, could be positioned in a separate building in a same campus, or could be positioned in a different city. The processing circuitry is configured to transmit the data to the maintenance data server 136 by a datalink 132 and may utilize one or more computer networks 134. The communication from the sensor assembly to the processing circuitry is bi-directional, such as collecting data from the sensor assembly and sending firmware from the processing circuitry to the sensor assembly.

If the monitoring system 100 is installed in a home or relatively small area, where there are a small number of air filters, such as less than 10, each filter may have the processing circuitry physically adjacent to the air filters such that each of the different processing circuitry may transmit processed data to a homer owner or user's hand-held computing device, such as through a home or small WiFi network. In contrast, if the monitoring system is in a larger building with a relatively large number of air filters, such as greater than 25, each filter may include processing circuitry that is positioned adjacent to the vent to collect and transmit the data to a different location for data processing. This remote data processing can be within the server 136, which may be a physical server on site or may be remote (in the Cloud).

FIG. 1 is a simplified example of a single air filter 102 to illustrate aspects of different components of the monitoring system. The air filter is shown in two views in FIG. 1, a side view 112 and a front view 110. The air filter 102 includes a filter material 111, which is illustrated as a plurality of holes 113 through which air may flow. In application, the plurality of holes may be a mesh or other filter material with various layers of overlapping sheets that allow certain sized particles to pass.

The side view 112 illustrates the air filter partially inserted into an air filter housing 114 that is part of an air handling, or HVAC, system 116. The air filter housing 114 is a frame or support that receives and holds the air filter in place while minimizing impact to the airflow. The air handling system 116 includes a blower 118, or fan coupled to the air ducts or vent 120. The air filter housing 114 is positioned within an airstream or airflow 124 from the blower 118 toward an end 117. The airflow 124 is shown in the air ducts 120, having a direction from the blower. The first MEMS pressure sensor 104 is positioned upstream of the air filter 102 in airflow 124, i.e., on the first side 105 of the air filter. In other words, the first MEMS pressure sensor 104 is positioned to encounter airflow 124 prior to airflow 124 entering air filter 102. The first MEMS pressure sensor 104 may also be known as the "upstream pressure sensor." The second MEMS pressure sensor 106 is positioned downstream of the air filter 102, i.e., on the second side 107 of the air filter. The second MEMS pressure sensor 106 is positioned to encounter the airflow 124 after the airflow 124 has exited the air filter 102. The second MEMS pressure sensor 106 may also be known as the "downstream pressure sensor."

The first and second MEMS pressure sensors 104 and 106 may be mechanically coupled to the air filter housing 114. Alternatively, the first and second MEMS pressure sensors 104 and 106 may be mechanically coupled to the ducts 120 or to air filter 102, or some combination thereof. As shown in FIG. 1, the first and second MEMS pressure sensors 104 and 106 are electrically coupled to each other using an electrical coupling or support 126. The electrical coupling 126 may be a printed circuit board or other substrate to support the sensors and may include an inter-integrated circuit or $I^2C$, wires, or other communication or data transfer components to couple the first and second MEMS pressure sensors together. The processing circuitry is electrically coupled to the electrical coupling 126 for communication with the first and second MEMS pressure sensors 104 and 106. The processing circuitry 108 may be located close to the first or second MEMS air pressure sensors 104 and 106 or near the air filter housing 114 for example. The processing circuitry retrieves air pressure data from the first and second MEMS air pressure sensors 104 and 106.

In some embodiments, the processing circuitry may include a microcontroller coupled to the support 126, which may be an EDGE of the air filter monitoring system. The application logic can be performed in the microcontroller, such as averaging the air pressure data over time, evaluating and comparing the averages of different time periods, determining an air filter contamination level, and storing the data. These averages can be used to reduce electronic and air turbulence noise. The microcontroller can associate and track the air filter contamination level with a date, or time, stamp.

The monitoring system can also include a hub or GATEWAY that is coupled to each of the air filters and respective microcontrollers, i.e. each microcontroller gathers data from the corresponding air filter and transmits that data to the hub or GATEWAY. The GATEWAY can include a processor or controller that can perform the application logic. Alternatively or simultaneously, the application logic can be performed in the EDGE and the GATEWAY. In some embodiments, the EDGE performs a first set of data analysis associated with processing the data received from the corresponding air filter and sensors and the GATEWAY performs a second set of data analysis that is based on the output of the first set of data analysis at the plurality of EDGES. The first set of data analysis could include generating a daily average of air flow of each air filter. The second set of data analysis could include collecting the daily average of each air filter within the system and ranking the average from best to poorest performance. The second set may have a threshold performance rating that sends a notification to a system maintenance tracking device, i.e. to a user, that lists any air filters that are performing lower than the selected performance threshold.

The monitoring system can also include a CLOUD or remote maintenance data server 136 that is coupled to one or a plurality of GATEWAYS. The GATEWAYS may be installed as one GATEWAY per building or a single building could have several regions, each of which has a GATEWAY. The CLOUD is coupled to and receives data from the plurality of GATEWAYS. The application logic can be alternatively performed in the CLOUD, the GATEWAYS, or in the EDGES.

In one example, all of the data collected by each set of sensors at each air filter is transmitted and stored in the CLOUD, which allows for flexibility in timing and location of performing computations or data analysis. For example, the application logic for the whole monitoring system may be performed periodically and not in real-time. This may be useful for a large building complex or company with buildings in different time zones. Overall, the system can operate at a lower speed for data processing as a life of each air filter is measured in months. This allows for some latency without negatively impacting the results. As such, some of the computations can be performed days or even weeks after the measurements are taken. In some embodiments, instead of real time measurements, the system could measure air flow weekly and generate a monthly average for each air filter. In such embodiments, all computations may be performed in the CLOUD, such that raw data is sent from the EDGE to the CLOUD. In this case, the EDGE circuitry would be relatively simple as no computation would be performed at the EDGE. The EDGE circuitry may include hardware and software for data collection and formatting for transferring to the CLOUD.

Some organizations may choose such a frequency of data collection to manage power consumption. Each organization can select a frequency of data collection based on their use and performance requirements of their individual buildings. Some of the monitoring systems may have a combination of data processing, i.e. some of the air filter may transmit to the CLOUD directly while other air filters, such as in particular high filter performance environments, like a lab or a semiconductor fabrication facility, may have more active, more frequent data collection, immediate processing, and transmission to the CLOUD.

As used herein, the term "circuitry" may comprise, individually or in any combination and as non-limiting examples: hardwired circuitry, programmable circuitry such as computer processors comprising one or more individual instruction processing cores, state machine circuitry, and/or firmware that stores instructions executed by programmable circuitry. The circuitry may, collectively or individually, be embodied as circuitry that forms part of a larger system, for example, an integrated circuit (IC), system on-chip (SoC), desktop computers, laptop computers, tablet computers, servers, smartphones, etc. The processing circuitry 108 may further include one or more memory circuitry elements to store information, such as code and/or data used by the processing circuitry during execution, and/or persistent data associated with an application or user. Such memory elements may include any type or combination of components capable of storing information, including volatile memory (e.g., random access memory (RAM), dynamic RAM (DRAM), synchronous dynamic RAM (SDRAM), and static RAM (SRAM)) and/or non-volatile memory (e.g., storage class memory (SCM), direct access storage (DAS) memory, non-volatile dual in-line memory modules (NVDIMM), and/or other forms of flash or solid-state storage). A combination of the first and second MEMS sensors 104 and 106 with the processing circuitry 108 may be called a sensor assembly 115.

The electrical coupling 126 is formed within a structure 127. The structure 127 may be a flexible support or rigid support onto which each of the first and second pressure sensors are attached. Each pressure sensor is a standalone package, having a MEMS die encased in a molding compound with the opening. Power and control signals are provided through the support to the pressure sensors. A first portion 127*a* of the support is positioned adjacent to a first wall 121. The first portion 127*a* may be in direct contact with the first wall 121 or with a surface of the housing 114. A second portion 127*b* is on or overlapping with the first side 105 of the air filter, i.e., on the fan side of the duct. A third portion 127*c* is on the second side 107 of the air filter, i.e., spaced further from the fan than the first portion 127*a*. An end 127*d* is closer to the first wall 121 than a second end 127*e* of the support 127.

Positioning of the first and second MEMS pressure sensors 104, 106 may be such that the first MEMS pressure sensor 104 and the second MEMS pressure sensor 106 are not aligned with each other within the airflow 124. Alignment of the sensors in the airflow 124 may impact the effectiveness of the second MEMS pressure sensor 106, which may cause erroneous or erratic pressure readings due to air turbulence caused by the first MEMS pressure sensor 104. In a preferred embodiment, the first and second MEMS pressure sensors 104 and 106 are separated from each other in a direction transverse to the direction of airflow 124.

The first MEMS pressure sensor 104 is positioned closer to a first wall 121 than a second wall 123 of the duct 120. The second MEMS pressure sensor 106 is closer to the second wall 123 than the first wall 121. The first MEMS pressure sensor 104 is spaced from the second MEMS pressure sensor 106 by a distance 125 in a first direction that is transverse to the airflow. The duct has a centerline that is positioned between a location of the first sensor 104 and the second sensor 106.

Each MEMS pressure sensor includes an opening to allow the pressure sensor access to the airflow. The opening of each of the sensors is facing the fan. An orientation of the pressure sensor opening with respect to the airflow 124 direction affects the pressure being sensed. If the opening is 180 degrees opposite the direction of airflow 124 (the opening facing into the airflow) the sensor will sense a "total," or "stagnation," pressure of airflow 124. The monitoring system is configured to detect if a sensor is positioned incorrectly within the duct such that a technician could be alerted to address the issue. For example, there could be a threshold value below which a stagnation or incorrect position flag or alert could be triggered.

If the opening is transverse to the direction of airflow 124, it will sense a "static" pressure, which will be equal to or less than the total pressure. In the present embodiment, the orientation of the first and second MEMS pressure sensor openings are to the direction of the airflow 124, i.e., facing into the airflow 124. In other embodiments the orientation of the first and second MEMS pressure sensor openings may be transverse to the direction of the airflow 124.

In the depicted embodiment, the air filter monitoring system 100 includes a data link 132 and one or more computer networks 134. The data link 132 may be, as a non-limiting example, a low power link coupling the processing circuitry 108 to the network(s) 134. The data link 132 may include one or more wireless links (e.g., Bluetooth, Zigbee, or IEEE 802.11 wireless protocols), or one or more wired links, such as $F^2C$, 1-Wire or Ethernet.

The computer network(s) 134 may be used to facilitate communication between the components of the air filter monitoring system 100. For example, the processing circuitry 108 and maintenance data server 136 may use computer network(s) 134 to communicate with each other and/or access one or more remote data services (not shown), such as a maintenance data service or cloud computing service. Network 134 may include any number or type of communication networks, including, for example, local area networks, wide area networks, public networks, the Internet, cellular networks, Wi-Fi networks, short-range networks (e.g., Bluetooth or ZigBee), and/or any other wired or wireless networks or communication mediums. While not depicted for the sake of clarity, the processing circuitry 108 may utilize one or more additional intermediary networking components (e.g., edge gateways, switches, and routers) to enable and/or access one or both of data link 132 and computer network(s) 134.

In certain embodiments, the air filter monitoring system 100 may include or utilize one or more devices capable of communicating and/or participating in an Internet-of-Things (IoT) system or network. IoT systems may refer to new or improved ad-hoc systems and networks composed of multiple different devices interoperating and synergizing for a particular application or use case. Such ad-hoc systems are emerging as more and more products and equipment evolve to become "smart," meaning they are controlled or monitored by computer processors and are capable of communicating with other devices. For example, processing circuitry 108 may include a computer processor and/or communication interface to allow interoperation with other networked elements, such as with maintenance data server 136 and/or remote data services and hand-held computing devices (i.e. phones or tablets of maintenance team members). Exemplary IoT devices may be "greenfield" devices that are developed with IoT capabilities from the ground-up, or "brownfield" devices that are created by integrating IoT capabilities into existing legacy devices that were initially developed without IoT capabilities. For example, in some cases, IoT devices may be built from sensors and communication modules integrated in or attached to devices such as equipment, toys, tools, vehicles, and so forth.

In operation, the processing circuitry 108 processes air pressure readings from the first and second MEMS air pressure sensors 104 and 106 in order to determine a quality condition of the air filter, and provides data representing that determination to the maintenance data server 136 via data link 132 and network 134. The system can be set to collect air pressure sensor data at a particular frequency, such as once a day, once a month, or some other frequency relevant to the environment in which it is being used. For example, surgery rooms of a hospital may monitor air quality and filter performance on a higher frequency than a gym. Once the frequency is set, the system will collect the air sensor data, process the capture data, and either store it or transmit it to the data cloud 134, or both.

In certain embodiments, a user or monitoring team can select or otherwise specify the frequency at which the collected data is transmitted to the remote maintenance server. As non-limiting examples, such transmissions may be configured to occur periodically (e.g., once a week, once a month, or some other interval), or in response to one or more events (such as upon HVAC system initialization, upon collection of a specified quantity of data samples, immediately upon collection of each data sample, etc.).

The processing circuitry 108 may communicate the air filter condition data from a plurality of filters of an HVAC system or a plurality of HVAC systems to a user or monitoring team or a premises manager. For example, a single office building includes a plurality of air filters distributed throughout its network of ducts. A building maintenance team may be able to monitor the air quality of the office building via a computing application (or "app") that may, in certain embodiments, provide real-time data about each and every air filter in the building. Each air filter may be fitted with a pair of pressure sensors, such as the first and second pressure sensors 104 and 106 of FIG. 1. In certain embodiments, the maintenance data server 136 may collect historical data about standard operation of the air filters during different seasons and air temperatures outdoor and indoor. Exterior pollutants or contaminants may change based on the season as well. This is discussed in further detail below with respect to FIG. 7.

In various embodiments, the maintenance data server 136 may aggregate the filter condition data for each air filter 102 monitored, determine replacement dates for each air filter 102, and notify maintenance personnel (such as via a computing application being executed by one or more client devices) of one or more maintenance events, such as when to replace the air filter 102.

Figure 2A:
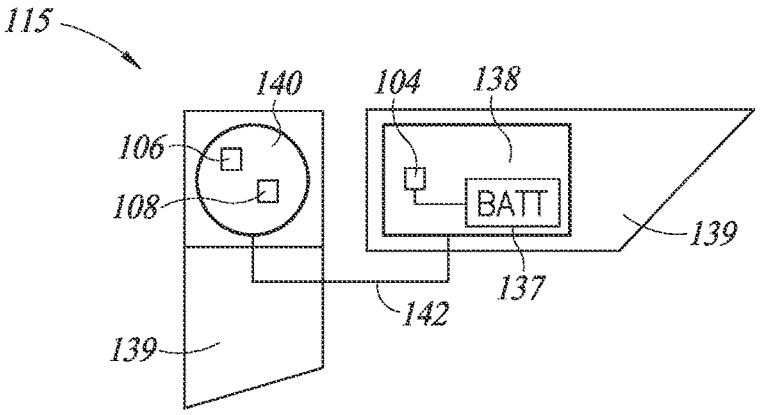
FIG. 2A is a system diagram of the sensor assembly of the embodiment of FIG. 1.

FIG. 2A is a diagram of the sensor assembly 115. The sensor assembly 115 includes a first sensor module 138 and a second sensor module 140, electrically coupled together, such as by an $I^2C$ bus 142. The first sensor module 138 includes the first MEMS air pressure sensor 104. The second sensor module 140 includes the second MEMS air pressure sensor 106 and the processing circuitry 108. The second sensor module 140 may also include a power source 137, such as a battery.

Alternatively, the first module 138 may house and support the battery 137 and the processing circuitry 108. There is great flexibility as to how the combination of the first and second sensors, the power supply, and the processing circuitry can be assembled. FIG. 2A is one of many examples. Different assembly arrangements will be created to address different physical orientations and sizes of air filters, ducts, and filter holders.

Each of the first and second sensor modules may be a printed circuit board that supports a plurality of active and passive components. The first sensor module is illustrated as rectangular and the second sensor module is illustrated as circular. The sensor modules may be a variety of shapes. The sensor modules are sized and shaped to be carried by a support that has an interior slot that receives and holds the printed circuit board. The air filter assembly may have a corresponding receptacle or opening into which an angled end of the support 139 can be securely fixed. This allows for secure placement of the sensor modules in the airstream while making the sensor modules easy to replace in the event aspects of the sensor modules fail. While the supports 139 are illustrated as having a rectangular end and an angular end, this is only one simplified configuration of supports for the first and second sensor and associated components.

Figure 2B:
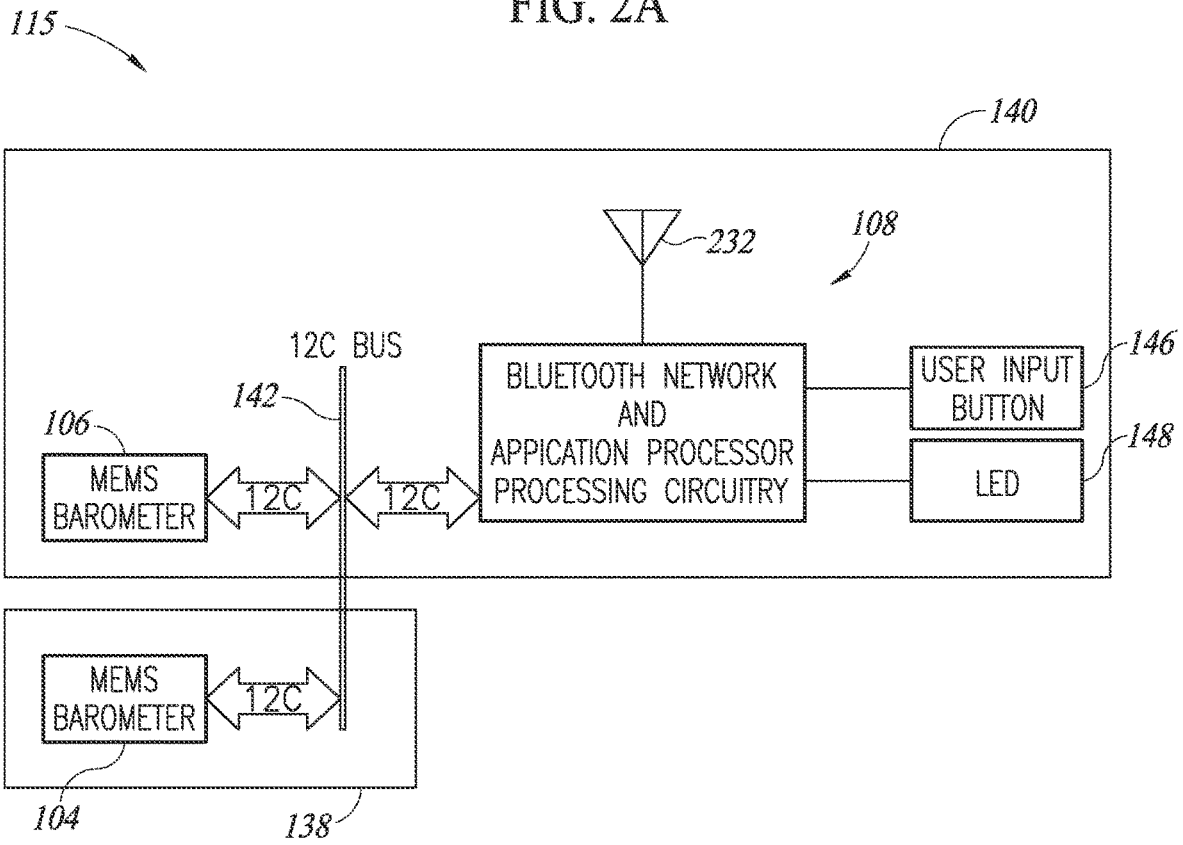
FIG. 2B is a schematic block diagram of the sensor assembly of the embodiment of FIG. 1.

FIG. 2B is a block diagram of the sensor assembly 115. The sensor assembly 115 includes the first sensor module 138 and the second sensor module 140. As noted above, the sensor modules 138 and 140 may be printed circuit boards upon which components are mounted. The sensor modules 138 and 140 provide a surface or physical structure to couple the first and second MEMS air pressure sensors 104 and 106 to the air filter housing. The first sensor module 138 includes the first MEMS air pressure sensor 104, or first MEMS barometer. The second sensor module 140 includes the second MEMS air pressure sensor 106, or second MEMS barometer, and the processing circuitry 108. The first MEMS air pressure sensor 104 communicates with the processing circuitry 108 via an electrical connection, of which a non-limiting example is the $I^2C$ bus 142. The second MEMS air pressure sensor 106 also communicates with the processing circuitry 108 via $I^2C$ bus. The sensor assembly 115 may also include user input buttons 146 and visual indicating LEDs 148 coupled to processing circuitry 108 for use in setting up the sensor assembly 115, visually locating the sensor assembly 115 from a distance, or other uses deemed useful in installing and maintaining the sensor assembly 115. In the depicted embodiment, the sensor assembly 115 further includes wireless communications interface 232, which enables the sensor assembly 115 to communicate with one or more additional components (not shown) of an air filter quality monitoring system, such as air filter monitoring system 100 of FIG. 1.

Figure 3:
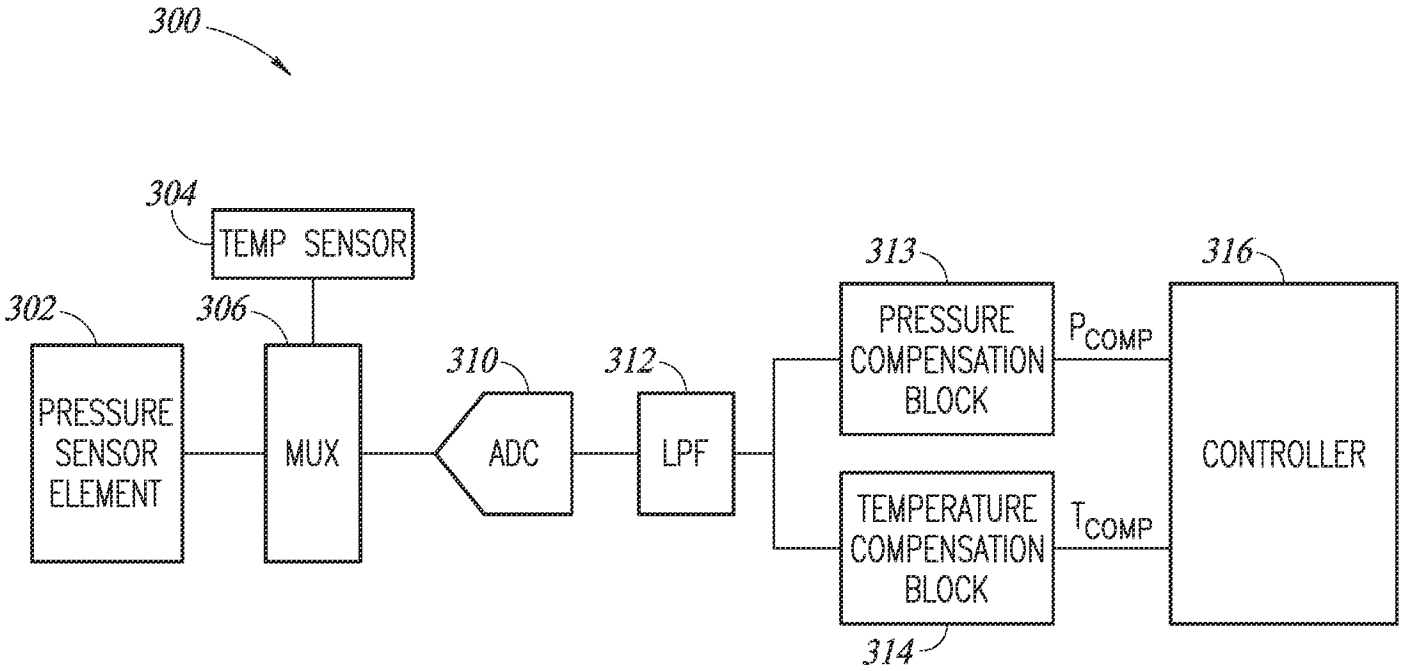
FIG. 3 is a block diagram of an alternative embodiment of an air filter monitoring system of the present disclosure.

FIG. 3 is a block diagram of an alternative embodiment of the present disclosure that includes a sensing assembly 300 to detect pressure and other environmental factors within an air duct. The sensing assembly 300 includes a pressure sensor 302 that is configured to be positioned within an airflow within the duct. A temperature sensor 304 may be coupled to the pressure sensor and to a multiplexer 306. The assembly 300 may include an analog to digital converter (ADC) 310 coupled between the multiplexor and a low-pass filter 312. Further, the assembly may include a pressure compensation block 313, a temperature compensation block 314, and a controller 316, among other things.

The pressure sensor 302 can generate a differential voltage proportional to an absolute pressure using a piezoresistive bridge on a suspended membrane. There are a variety of other types of pressure sensors that may be utilized to implement this monitoring system. The piezoresistive example is a non-limiting example.

The temperature sensor 304 is configured to sense or measure the temperature near the pressure sensor. The multiplexer 306 may select between the pressure sensor 302 and the temperature sensor 304. The multiplexor and temperature sensor are optional features. The output of the multiplexor may be amplified for digitization by the analog to digital converter (ADC) 310. The digitized pressure and temperature is passed to the digital low pass filter 312 to remove noise. A digital output of the low pass filter is transmitted to the both the pressure compensation block 313 and the temperature compensation block 314. The pressure compensation block 313 may use stored historical data from prior data collection to correct for offset in the pressure sensor, such as variations that depend on temperature. The temperature compensation block 314 uses data from prior temperature data to correct for offset in the temperature sensor 304 output. The compensated pressure data Pcomp and compensated temperature data Tcomp may be stored in data registers in the controller 316 or in a separate memory. Each pressure sensor may have this assembly or a second sensor may be electrically coupled to this sensor for data collection and processing by a single assembly 300 for each pair of sensors. The pressure sensors may be configured to sample pressure and temperature at various sampling frequencies fs, for example 1 Hz, 10 Hz, 25 Hz, 50 Hz, and 75 Hz. A pressure sensing range maybe selected for each potential application of the monitoring system. Variations in the frequencies and other thresholds will be adapted to the end use environment. For example, an absolute pressure sensing range of 260-1260 hPa (hecto Pascals) may be adequate, having an absolute accuracy of +/−0.1 hPa over an 800-1100 hPa range.

Figure 4:
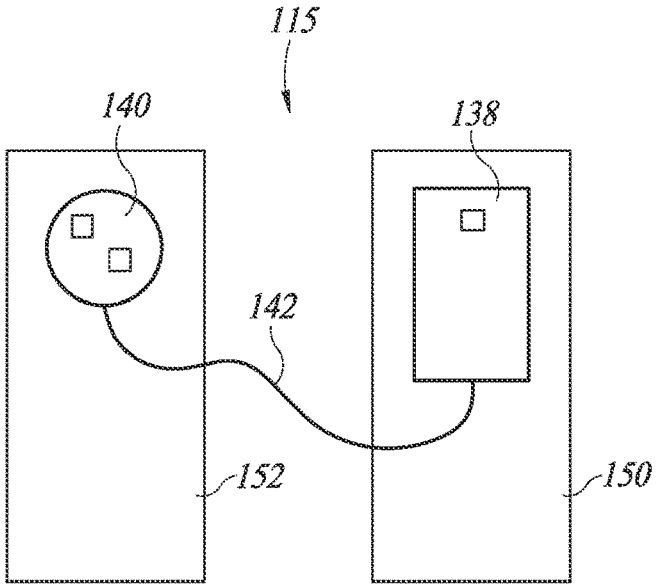
FIG. 4 is a system diagram of an alternative embodiment of the sensor assembly of FIG. 2A.
Figure 5:
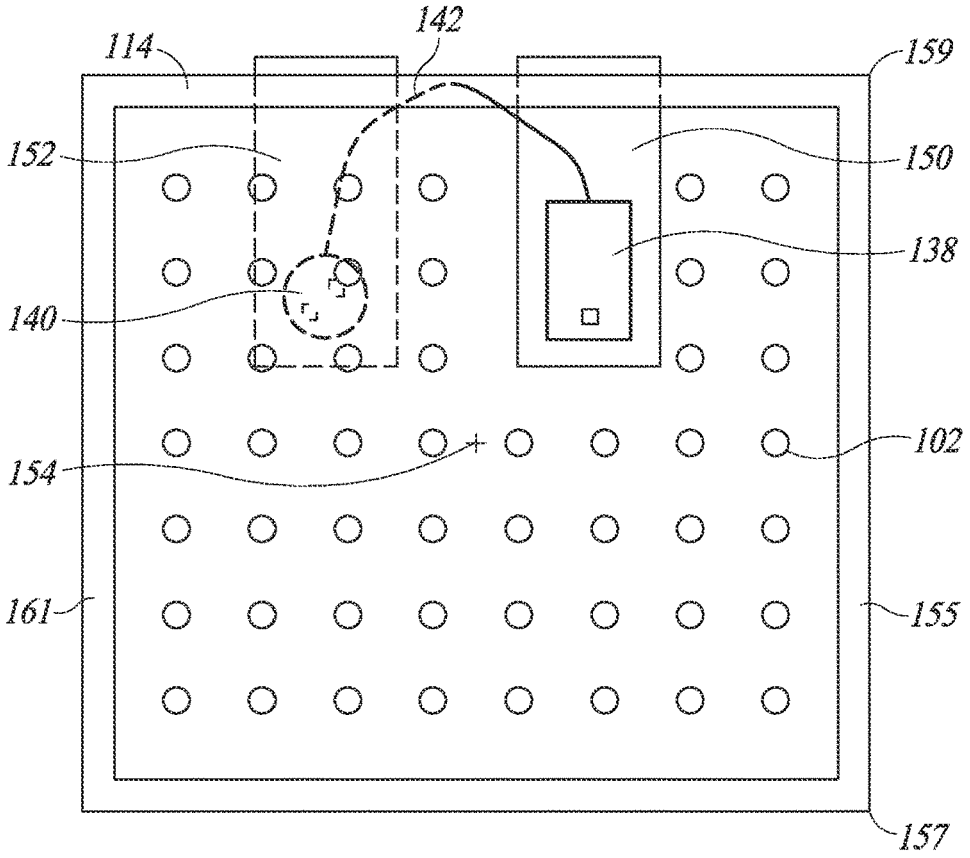
FIG. 5 is a front view of an air filter having the sensor modules of the sensor assembly arranged one in front of the air filter and one in back of the air filter.

FIGS. 4 and 5 are an alternative embodiment of the sensor assembly 115 of FIG. 2A, having the first sensor assembly 138 and the second sensor assembly 140 coupled to a first clip 150 and a second clip 152, respectively. The first and second clips 150 and 152 are coupled to the filter holder 114 such that the first sensor assembly 138 is on the first side of filter 102 and the second sensor assembly 140 is on the second side of filter 102. The first side of filter 102 being the side of filter 102 that first encounters the airstream. The second side of filter 102 being the side of filter 102 from which the airstream exits filter 102. The first and second sensor assemblies 138 and 140 may be placed near a center 154 of the filter 102.

While illustrated as being positioned near a top of the filter 102, the first sensor assembly 138 and the second sensor assembly 140 may be positioned on a same side of the filter. For example, the first sensor assembly 138 could be positioned along a first side 155 adjacent to a first corner 157 and the second sensor assembly 140 may be positioned along the same first side 155 adjacent to a second corner 159. Alternatively, the first sensor assembly may be positioned along the first side while the second sensor assembly is positioned along a second side 161.

The first sensor assembly is to be positioned in a manner that does not impede the airflow detected by the second sensor assembly. Various positions can achieve this.

The first sensor assembly 138 is a support or substrate that includes one or more electrical components, that includes at least a first pressure sensor. The second sensor assembly 140 is a support or substrate that includes one or more electrical components, that includes at least a second pressure sensor. One or both of the supports may include a battery. In one configuration, only one of the supports includes a battery or power supply and the other support is coupled to a power supply.

The first and second sensor assemblies are illustrated as different shapes, i.e. a circle and a rectangle. The shapes of these assemblies are flexible and will be selected based on design parameters and clip design. Similarly, the clips 150, 152 are supports that are configured to house or hold the first and second sensor assemblies. These clips may be different shapes as well and will be selected based on HVAC system design parameters and filter parameters.

Figure 6:
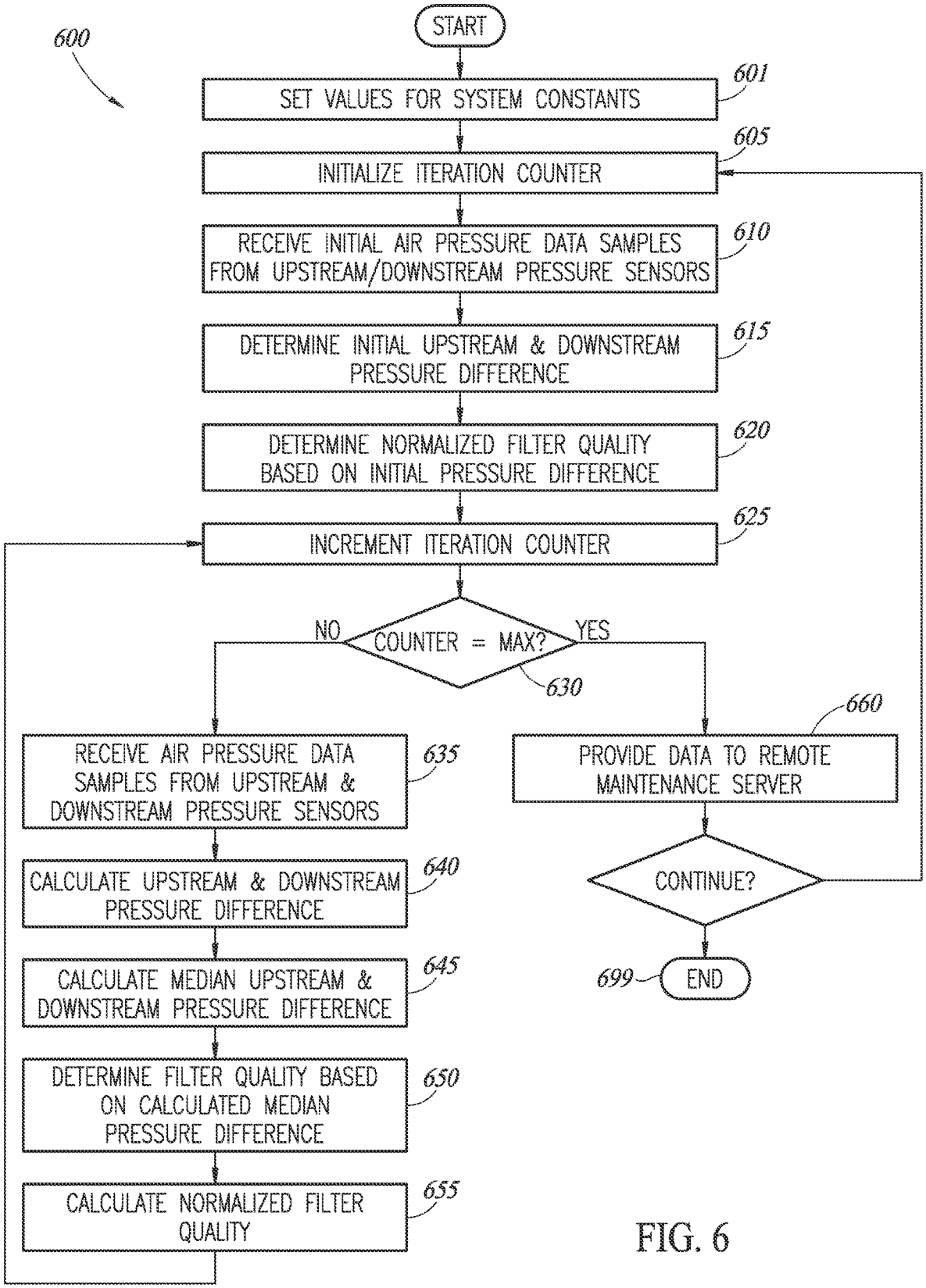
FIG. 6 is a method for determining air quality by processing circuitry using the air filter monitoring system of the present disclosure.

FIG. 6 is an exemplary process 600 in accordance with techniques presented herein, such as may be performed by the processing circuitry 108 (of FIG. 1) in order to determine the quality, performance, or health of an air filter. Air filter quality, as used herein, may in certain embodiments be quantified or normalized, such as via a numerical rating from 0 to 10, with 10 representing the highest air quality (lowest contamination) and 0 representing the lowest air quality (highest contamination). Alternatively, the system may quantify the health of the air filter based on threshold amounts of air flow passing through the filter. The system can, over time, collect data about air flow through a particular filter in a particular environment. For example, upon installation of a new filter, which may be triggered by an entry by the technician or building manager that the filter has been replaced or by automatic detection of a change in filter, such as if an accelerometer or gyroscope is included in at least one of the first and second sensor assemblies, the system will begin detecting an air flow through the new filter. This is a base line air flow. The base line air flow may be stored and averaged over multiple filter replacements so that there is an average expected air flow upon replacement. Between the replacement and the next replacement, the system can collect data about change in air flow and an associated amount of time since the filter has been changed. These amounts of time and associated air flow can be compared over time and averaged to develop thresholds. As these thresholds are developed as a system is in place, the system can then begin to alert the technician or building manager when a filter is deviating from the expected behaviors based on the historical performance of that filter in the particular HVAC system.

The process 600 begins at block 601, in which values for various system constants are set and/or retrieved, such as part of system initialization or configuration. As non-limiting exemplary values for use with the depicted embodiment, a proportional delta pressure low-pass filter constant $K_k$ is set to a value between 0 and 1, such as 0.95; a proportional pressure low-pass filter constant $K_p$ is also set to a value between 0 and 1, such as 0.95; a filter quality normalization constant $K_q$ is set to a value between 1 and 100, such as 7.

The process continues to block 605, in which an iteration counter is initialized (e.g., set to 0). In the depicted embodiment, a maximum value for the iteration counter is also configured to determine a quantity of data samples to use for determining an updated normalized filter quality, such as to provide the updated normalized filter quality value to a remote maintenance server. In certain embodiments, the maximum value for the iteration counter may be set as part of setting and/or retrieving the values for the various system constants in block 601.

The process continues to block 610, in which initial air pressure data samples are received from upstream and downstream pressure sensors (e.g., from upstream air pressure sensor 104 and downstream air pressure sensor 106 of FIG. 1). Assume for this example that initial values for upstream pressure $P_a$ and initial downstream pressure $P_b$ are received and then stored in array locations $P_a[0]$ and $P_b[0]$ in one or more memory elements of the relevant processing circuitry. It will be appreciated that as described herein, data values described as being determined, received, or calculated may, in at least some embodiments, additionally be stored by memory elements incorporated within or communicatively coupled to the relevant processing circuitry (e.g., processing circuitry 108 of FIG. 1). The process then continues to block 615.

At block 615, an initial pressure difference between the sensed upstream air pressure sample and the sensed downstream air pressure sample is determined. In the depicted embodiment, a difference in pressure DeltaP is determined by subtracting $P_b[0]$ from $P_a[0]$ and stored in an array location DeltaP[0]; a median difference in pressure DeltaPmed is initialized to DeltaP[0] and stored in an array location DeltaPmed[0]. The process continues to block 620.

At block 620, a normalized value representing filter quality is determined based on the initial pressure difference. For example, a normalized filter quality Quality[0] may be initialized to the highest value (in this example, 10). By such normalization, the processing circuitry recognizes that the highest air filter quality will be associated with the earliest samples received for that air filter.

The process continues to block 625, in which the iteration counter initialized in block 605 is incremented, and then to block 630. At block 630, it is determined whether the iteration counter is equal to its maximum configured value Max_n. For purposes of this description, assume that the iteration counter is still less (e.g., n=1) than Max_n, such that the process continues to block 635.

At block 635, the processing circuitry receives additional air pressure data samples from the upstream and downstream pressure sensors.

The process continues to block 640, in which the processing circuitry calculates the current pressure difference between the upstream and downstream data samples—the pressure difference between sides of filter 102. In the depicted embodiment, the upstream pressure $P_a$ and the downstream pressure $P_b$ are read and stored in array locations $P_a[n]$ and $P_b[n]$, the pressure difference DeltaP is determined by subtracting $P_b[n]$ from $P_a[n]$, and the result stored in array location DeltaP[n].

The process then continues to block 645, in which a median pressure difference DeltaPmed is calculated using a median pressure difference equation:

$$\text{DeltaPmed}[n]=Kk*\text{DeltaPmed}(n-1)+(1-Kk)*\text{DeltaP}[n]$$

The median pressure difference equation implements a first order infinite impulse response (IIR) filter that has a low-pass transfer characteristic described by a frequency response function:

$$|\mathcal{H}_k(\hat{\omega})|^2 = \frac{K_k^2}{1-2(1-K_k)\cos(\hat{\omega})+(1-K_k)^2}$$

where a normalized frequency $\hat{\omega}$ is related to frequency f and a sampling frequency $f_s$ by:

$$\hat{\omega} = 2\pi\frac{f}{f_s}$$

Using the above equations, the proportional delta pressure low pass filter constant $K_k$ may be calculated by specifying a 3 dB corner frequency $f_c$ and setting the square of the magnitude of the frequency response $|\mathcal{H}_k(\hat{\omega}_c)|^2=½$.

The process continues to block 650, in which a filter quality FilterQual is determined based on the median pressure difference DeltaPmed, such as via a filter quality difference equation:

$$\text{FilterQual}[n]=Kp*\text{FilterQual}(n-1)+(1-Kp)*\text{DeltaPmed}[n]$$

The filter quality difference equation is similar to that of the median pressure difference equation above and implements a first order infinite impulse response (IIR) filter that has a low-pass transfer characteristic described by a frequency response function:

$$|\mathcal{H}_p(\hat{\omega})|^2 = \frac{K_p^2}{1-2(1-K_p)\cos(\hat{\omega})+(1-K_p)^2}$$

Using the above equations, the proportional delta pressure low pass filter constant $K_p$ may be calculated by specifying a 3 dB corner frequency $f_c$ and setting the square of the magnitude of the frequency response $|\mathcal{H}_p(\hat{\omega}_c)|^2=½$.

The process continues to block 655, in which a normalized filter quality Quality[n] is determined by dividing the absolute value of filter quality by the filter quality normalization constant $K_Q$, and then returns to block 625 to increment the iteration counter.

If at block 630 it is determined that the incremented iteration counter is still not equal to the maximum quantity of iterations Max_n, then the process initiates another data sample acquisition by proceeding to block 635; otherwise, the process continues to block 660, in which the communication circuitry provides data regarding the assessed air filter quality to a remote maintenance server (such as, with reference to FIG. 1, Maintenance Data Server 136 via wireless link 132 and network(s) 134). In the depicted embodiment, the processing circuitry provides to the remote maintenance server at least the last normalized filter quality Quality[n−1]. In certain embodiments, the processing circuitry may also provide various additional information to be stored and/or tracked by the remote maintenance server. As non-limiting examples, the processing circuitry may provide information regarding a date and/or time (e.g., a date stamp and/or timestamp) associated with the normalized filter quality; one or more intermediate data samples associated with the normalized filter quality; one or more calculated values for the median pressure difference; or other information. The other information may include sample data pressure from upstream or downstream sensors.

Following the provision of data to the remote maintenance server in block 660, the process 600 continues to block 690, in which it is determined whether to continue (such as in response to a termination request). If so, the process returns to block 605 and initializes the iteration counter; otherwise, the process continues to block 699 and ends.

It will be appreciated that additional embodiments of processes and methods implementing techniques described herein may contain additional operations not shown in FIG. 6, may not contain all of the operations shown in FIG. 6, may perform operations shown in FIG. 6 in various orders, and may be modified in various respects. As one example, the process 600 may be modified to utilize alternate difference equations, such as may be determined at the time of design, having other frequency response functions and filter constants. As another example, the iteration counter may be initialized after an initial normalized filter quality is determined based on an initial pressure difference. In addition, one or more operations may be adapted for use in processing circuitry having limited memory. Variables $P_a$, $P_b$ and DeltaP may employ current values; similarly, variables DeltaPmed, FilterQual and Quality may each employ a current value along with an immediately previous value, thereby potentially reducing memory requirements. Other embodiments (such as those that store some or all intermediate values) may correspond to greater memory usage. In certain embodiments, processing circuitry 108 may include a microcontroller (MCU) that performs operations to assess air filter quality in a very low power environment. In other embodiments, processing circuitry 108 may perform pressure compensation based on calibration of MEMS air pressure sensors over temperature and pressure including non-linear compensation over a pressure range and temperature.

Figure 7:
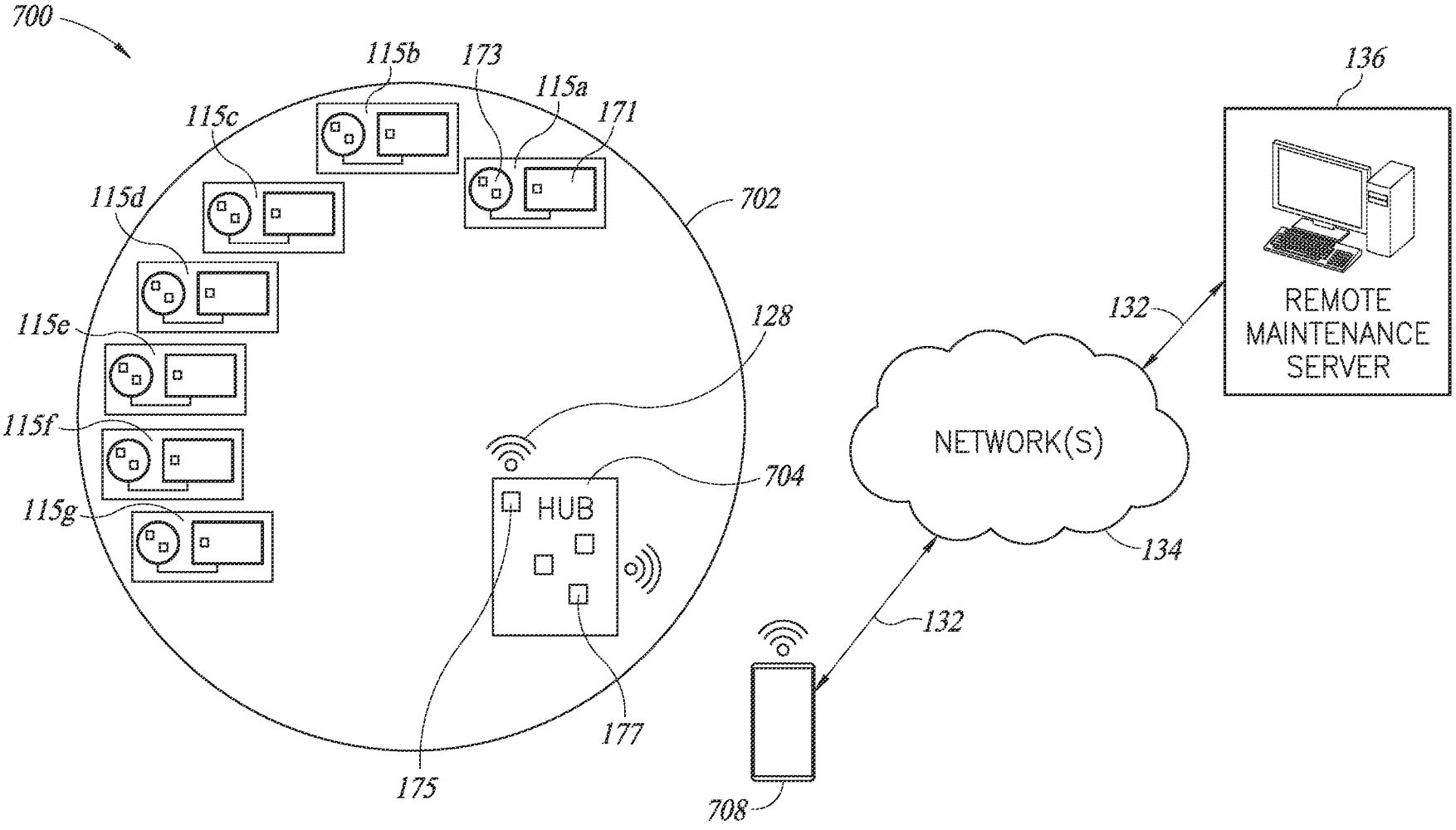
FIG. 7 is a system diagram of an embodiment of an air filter monitoring system utilizing a plurality of air filter monitoring nodes.

FIG. 7 depicts an exemplary air filter monitoring system 700 that includes seven sensor assemblies 115*a*-115*g* located at various locations within a user premises 702. Each sensor assembly 115*a*-115*g* monitors a distinct air filter (not shown) that may be positioned within different air vents of a single building or may be distributed in different air vents of a plurality of buildings. Each sensor assembly 115*a*-115*g* includes a first sensor module 171 and a second sensor module 173 that are configured to be located at different locations within an air flow of a respective vent. The first and second sensor modules will be positioned on different sides of the respective vent to detect a difference in the pressure on each side. The first and second sensor modules may be any number of shapes or sizes and include a variety of electrical components as described in this disclosure, including pressure sensors.

The sensor assemblies 115*a*-115*g* are configured to communicate with a sensor hub 704, such as wirelessly through a wireless link 128. The hub may be a Bluetooth Low Energy (BLE) device, which receives data from the sensor assemblies, and provides data to a remote maintenance server 136 via one or more computer networks 134. The hub includes transceivers 175 and at least one controller or processor 177 to receive and transmit the data collected at each of the sensor assemblies 115*a*-115*g*. There may be a single hub for a multi-building area or there may be sub-hubs positioned within each individual building that communicate with respective server assemblies in that building. Each sub-hub may communicate to a central or main hub in a multi-building complex. The central hub may be located in a building maintenance facility center. Alternatively, each sub-hub may communicate directly with the maintenance server 136, which may transmit data to a remote electronic device 708 associated with the building or premise 702 maintenance team, user, or manager.

The electronic device 708, such as a client computing device, mobile phone, tablet, hand-held computing device, or a desk top computing device may be used to communicate with the hub 704 directly or the hub may communicate with the remote maintenance server 136 directly. The electronic device of client computing device may be referred to as a Gateway device that is configured to communicate with the Edge devices (sensor assemblies). Alternatively, the hub may be omitted and the sensor assemblies may communicate directly with the electronic device 708. The location of the data processing and the communication path from the hub 704 to the user managing the system can be selected by the user and facility manager as best suits that premise or system. For example, in a single building, that has a limited number of air filters, such as 50 or less, the sensor assemblies may communicate directly with the electronic device for data collection and processing. In other embodiments, the sensor assemblies may communicate with the maintenance server and the electronic device (that also is communicatively coupled to the maintenance server).

In one configuration, the electronic device 708 may have an application that allows the user to configure and manage the sensor assemblies 115*a*-115*g*, such as by configuring the maximum iteration count Max_n and additional system constants (such as proportionality constants $K_p$ and $K_k$ and the quality normalization constant $K_Q$). In certain embodiments, client device 708 may be fixed or mobile, and may include instances of various computing devices such as, without limitation, desktop or other computers (e.g., tablets, slates, etc.), database servers, network storage devices and other network devices, smart phones and other cell phones, smart watches or other wearable devices, consumer electronics, digital music player devices, handheld gaming devices, PDAs, pagers, electronic organizers, Internet appliances, and various other consumer products that include appropriate communication capabilities. Client device 708 may communicate with remote maintenance server 136 for various purposes, including (as non-limiting examples) taking inventory of the sensor assemblies 115*a*-*g*; reading data from one or more of sensor assemblies 115*a*-*g* and/or hub 704; scheduling or providing information regarding one or more maintenance operations, such as in response to air filter quality information provided to the remote maintenance server; etc. In various embodiments, the client device 708 may provide additional functionality, such as to cause a sensor assembly to emit a sound or light to aid in locating the sensor assembly.

Figure 8:
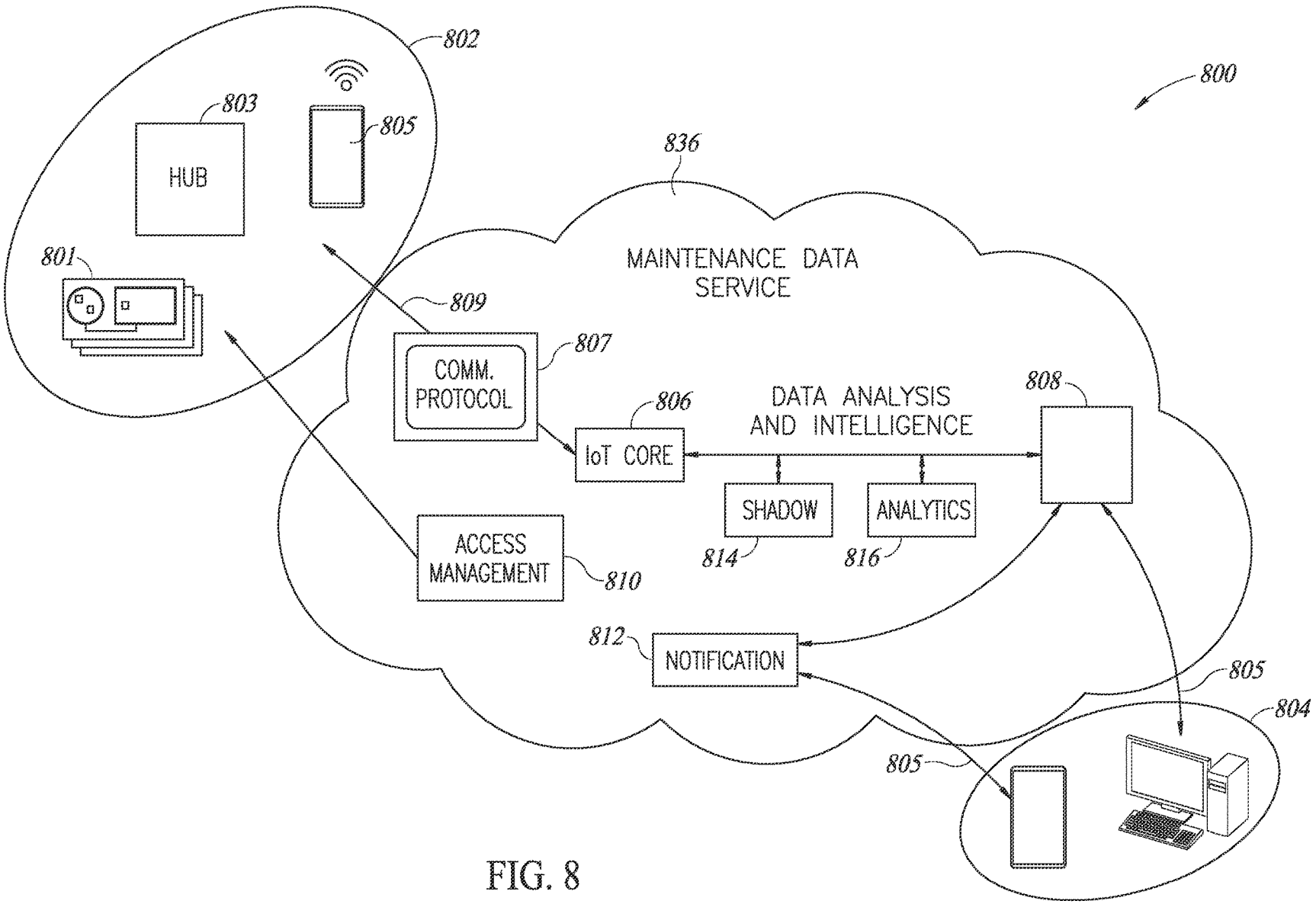
FIG. 8 depicts a networked system block diagram in accordance with techniques presented herein.

FIG. 8 is an alternative embodiment of an air filter monitoring system 800 that includes a maintenance data service 836. The system 800 includes an on-site sub-system 802 and a maintenance management system 804 that are coupled to the maintenance data services. The maintenance data service 836 includes an Internet of Things (IoT) or sensor assembly tracking core 806, a database or server 808, and an access management system 810. The core 806 enables tracking of the on-site sub-system 802, which includes a plurality of sensor assemblies. The on-site sub-system 802 also includes a Gateway or hub 803 that is optional. There may also be an electronic device 805. The sensor assemblies may be configured to either transmit directly to the core 806 or the maintenance data service or first communicate with the hub 803 or the electronic device 805, which would then communicate with the maintenance data service. There is flexibility so that the end user, facility maintenance team can configure the system as best suits their end use.

The core 806 can monitor and cooperate with the on-site sub-system as it is being connected, disconnected, sensor assemblies 801 are being added, replaced, and removed, and may in certain embodiments facilitate communication between the on-site sub-system and other remote servers or service providers. The core 806 may communicate with the on-site sub-system 802 using a communications protocol 807 such as (by way of a non-limiting example) Message Queuing Telemetry Transport (MQTT), a lightweight protocol that tolerates intermittent connections, minimizes the code footprint on devices, and reduces network bandwidth requirements. The MQTT protocol includes a message broker or agent and a plurality of clients (each sensor assembly). The message broker or aggregator receives data from each of the sensor assemblies and distributes the data to other systems within the maintenance data service 836. Data received is prioritized and when data is to be pushed to the sensor assemblies, there are parameters that the MQTT will use to distribute the data (like firm ware) to the sensor assemblies.

The database 808 is coupled with core 806 and enables organization and storage of sensor data (including as non-limiting examples normalized filter quality data, sensor assembly identifiers, and time/date stamps) and other data to track system wide historical behaviors and data over months and years for performance expected or observed at each air filter and vent in a building or complex of buildings.

In one embodiment, the access management system 810 may distribute security credentials to the on-site sub-system 802 in order to ensure equipment identification is reliable and to prevent equipment spoofing by attackers. This may include two-step authentication for access or an alert monitoring system to send an alert to the maintenance management system 804 if a sensor assembly has been removed or deactivated without the appropriate protocols being followed.

The maintenance data service 836 includes a shadow or back up system 814, an analytics system 816, and a notification service 812. The shadow 814 allows access to sensor assembly settings even if the sensor assembly is not currently online or otherwise connected to the on-site sub-system or maintenance data server 836. A sensor assembly shadow is created by maintenance data service 836 when a sensor assembly is added to the on-site sub-system 802. The sensor assembly shadow enables modification of sensor assemblies when they are connected. The analytics system 816 is coupled to the database 808 and accesses sensor assembly data as well as filter information to calculate filter replacement dates for each filter. In certain embodiments, the analytics 816 may include one or more machine learning components to analyze one or more data sets associated with used air filters, such as to calculate air filter replacement dates based on current performance and historical performance of previous filters. The system can track when the features of a type of air filter use may be different from a previously used air filter to be able to factor those differences into the analytics and historical behavior of the respective vent. The analytics system 816 may also modify previously scheduled replacement dates to expedite and simplify maintenance tasks, and may also facilitate simulation models of air filter life using one or more data sets from other similar filters that have been in service. Various scenarios and models may be simulated and integrated into the data analytics 816. The maintenance user 804 is coupled to the database 808 and the notification system 812 through a communications link 809 or other data transmission option. The maintenance management system 804 may be managed by one or more people who can pull filter data from the database 808, set notifications to be sent when selected thresholds are met on an individual sensor assembly level, on a building wide level, on a building complex scale, etc.

The data (temperature, pressure, humidity, vibrations, etc.) collected over time regarding a single vent or a whole vent system in a building or a complex of buildings can be processed and stored to generate mathematical and statistical predictive models for more efficient use of the HVAC system, for energy, materials, and labor savings among other things. Over sufficient data collection the system will learn expected behaviors, adjust threshold levels of air flow to be expected in different vents of the system, and can tune or adjust the systems' performance in response to the regular data collection. For example, the timing and performance expectations of each filter can be more precisely monitored, tracked, and prioritized with the better parameters computed thanks to the model. This can be computed in the cloud (remote server) or in more local processing circuitry. The computed data and improved parameters can be fed from the cloud (such as firmware updates) to each board (pressure sensor assembly, i.e. the Edge). This capability allows for a better identification, detection, prediction of power losses on the overall HVAC system, which in turn can improve energy efficiency and premises healthiness effective maintenance in terms of power consumption, healthiness. In addition, the same model could allow the Filter or HVAC system manufacturers to identify and improve the filter design by identifying specific design failures or vulnerabilities that are happening in a specific HVAC system or across a variety of non-related systems where their filters or products are used.

In one embodiment, the processing circuitry will create a replica of the HVAC system including each of the filter holders and historical and current filter data for each filter holder. The real time data is collected and transmitted pre or post-processing to the remote server for analysis and generation of the replica system for modeling and predictive analysis. The system algorithm can use artificial intelligence, machine learning and software analytics with spatial network graphs to create a digital simulation model of the HVAC system that can be regularly updated to adjust to the current environmental circumstances being detected by the sensors. The replica system is continuously updating, adjusting, and learning as new data is gathered. The replica system incorporates the historical data from past filters and sensor collection to create and manage the current replica and system management.

Figure 9:
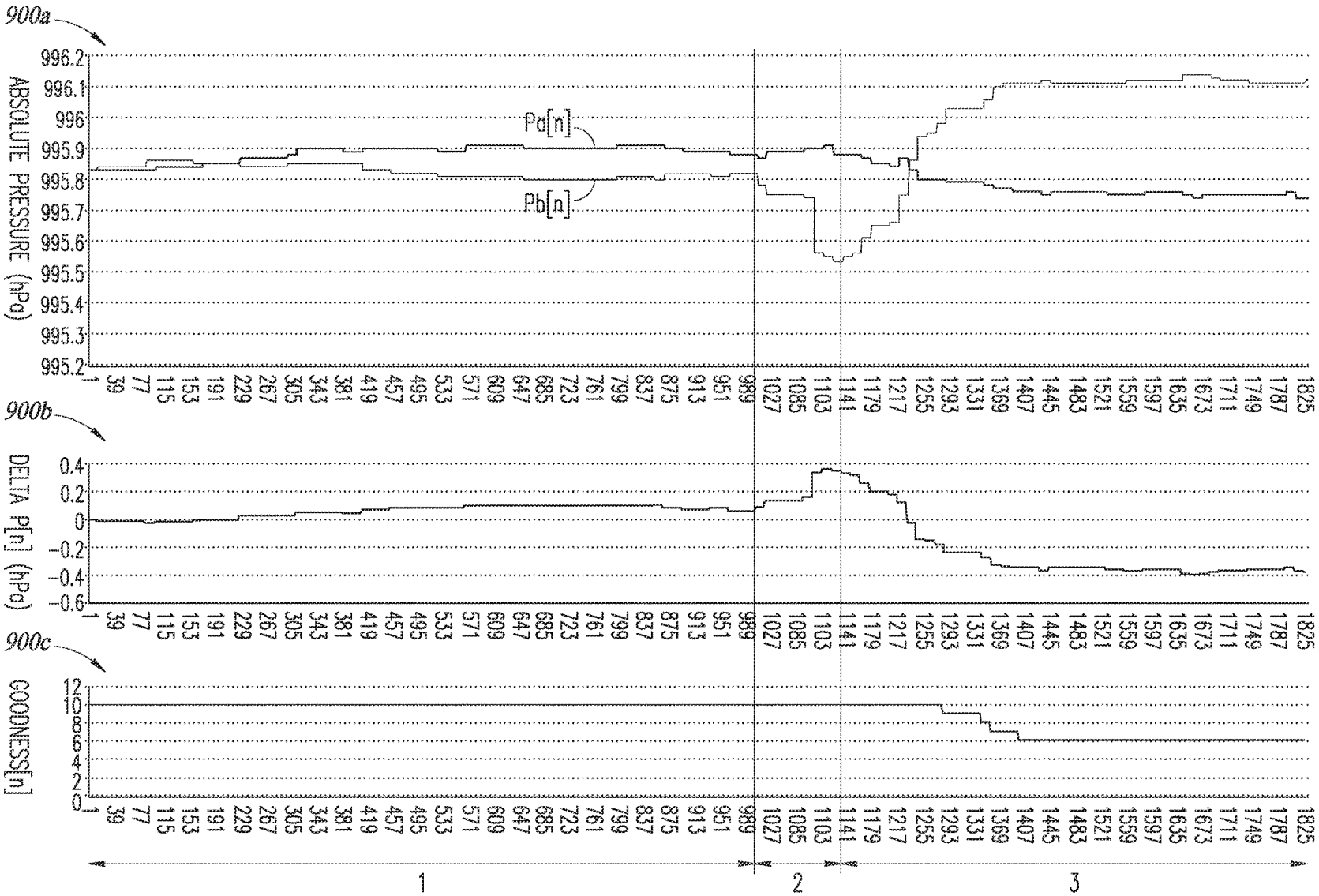
FIG. 9 includes graphs showing measured pressures across an air filter, the difference in air pressure, and a resulting normalized quality level.

FIG. 9 is a group of graphs 900*a*-900*c* illustrating operation of the sensor assembly 115 utilizing the methods of the present disclosure, such as the method described with respect to FIG. 6. A first graph 900*a* is absolute air pressure with an upstream air pressure $P_a$[n] and a downstream air pressure $P_b$[n], each are absolute pressure hPa as compared to a sample number n. A second graph 900*b* is a pressure difference DeltaP[n] as compared to a sample number n. A third graph 900*c* is a normalized filter quality Quality[n] (Goodness [N]) as compared to a sample number n. During a first time period 1, the filter is clean or otherwise "good". During a second time period 2, the filter is becoming clogged or dirty such that the performance is being impacted and the pressure difference is changing with respect to the first time period. The clogged or "dirty" filter may be removed and replaced during this time period. During a third time period 3, the system reflects operation with a very clogged or dirty filter that is not performing within a selected parameter.

The Goodness rating provides 10 as a starting point or normal operation with a clean filter. This is 100% efficiency. At the Goodness rating of 6, the filter is operating at 60% efficiency. At the Goodness rating of 0, the filter is completely blocked or clogged.

Advantages of embodiments of this disclosure include a low impact in hardware infrastructure at the user premises because the sensor assemblies and hub communicate without cable wiring. Sensor assembly devices are also low cost and have a low impact on air flow. A majority of computations may be performed via one or more remote servers, such as may be operated by a maintenance data service or other cloud service, which may have more robust access to power. Sensor assembly data accumulated via such servers may be used to create digital models to fine tune the tracing, predicting or emulating the behavior of the air filter and the entire HVAC system for added HVAC system efficiency and maintenance organization. Real time monitoring of the air filters may aid identification of functional or efficiency criticalities. In addition, automatic, personalized, maintenance notification may be sent by the notification system.

Figure 10:
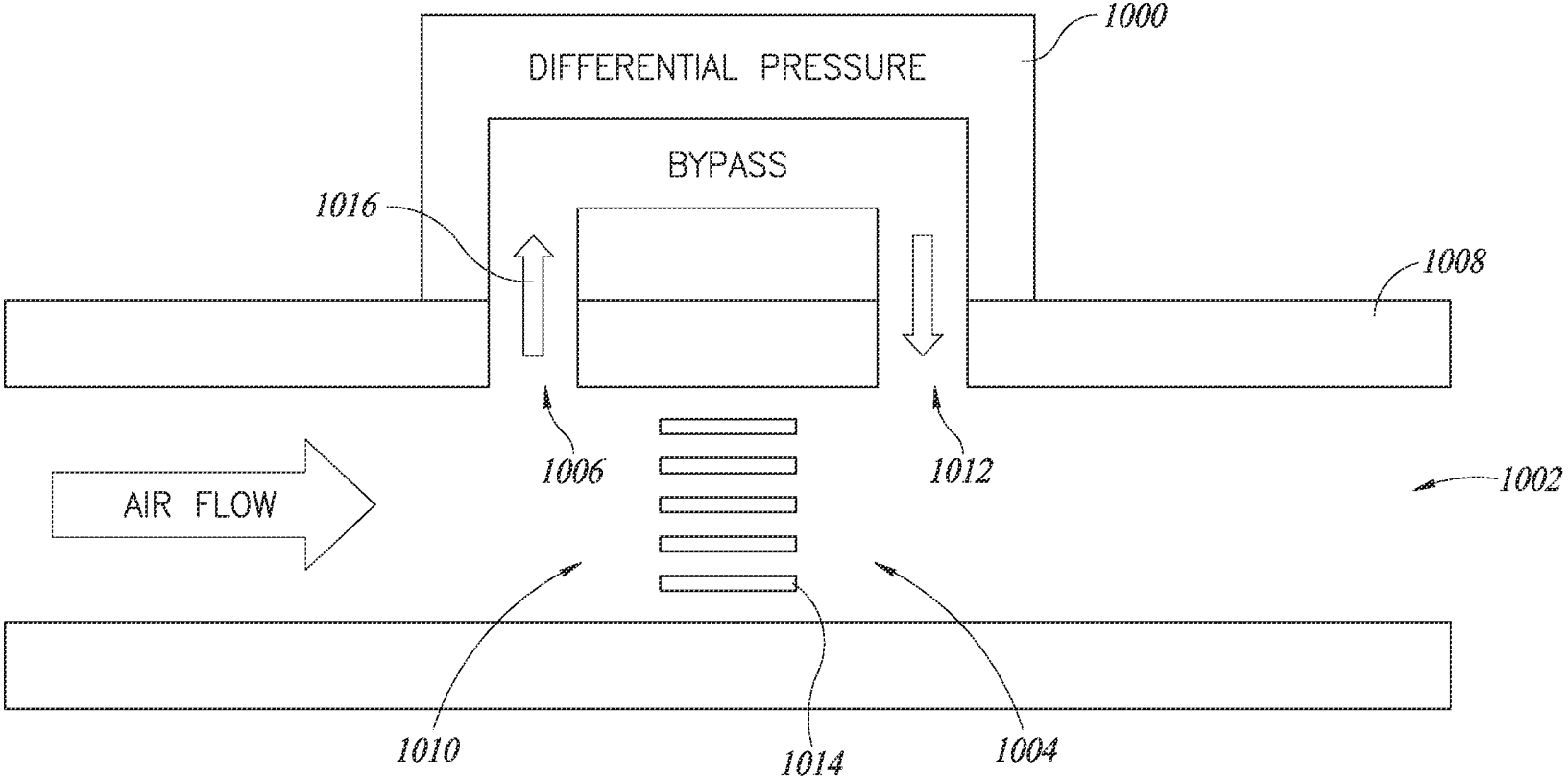
FIG. 10 is an alternative embodiment of a pressure sensor assembly having a differential pressure sensor.

FIG. 10 is an alternative embodiment of a pressure sensor assembly of the present disclosure that is directed to incorporating a differential pressure sensor or bypass pressure sensor 1000 that is coupled to a vent 1002 having an air flow from left to right in the illustration. A filter 1004 is positioned in the vent 1002. A first opening 1006 through a wall 1008 of the vent 1002 is positioned on a first side 1010 of the filter 1004. A second opening 1012 through the wall is on a second side 1014 of the filter 1004.

The differential pressure sensor 1000 is coupled to the first opening 1006 and the second opening 1012, such that a portion 1016 of the air flow enters the first opening from the first side of the filter. The portion of the air flow passes through a package or housing of the differential pressure sensor and exits from the second opening 1012, reentering the main air flow after passing through the filter.

Although not illustrated, the differential pressure sensor includes circuitry that collects the pressure data and transmits the pressure data to the processing circuitry of the system. The processing circuitry could be directly wired or be positioned remotely from the pressure sensor 1000. This differential pressure sensor may be incorporated in any of the various embodiments of the present disclosure instead of the first and second pressure sensors.

The differential pressure sensor may collect the pressure data about the respective vent and current air filter in real-time or periodically, such as daily, weekly, bi-monthly, etc. As the data is collected the pressure data is either processed locally, partially processed locally, or transmitted as raw pressure data to the remote maintenance server. Overtime the system will learn about the standard behaviors of the vent 1002, historical behavior and performance of each filter that has been in the vent 1002 (including length of time in position in the vent, the timing of replacement, and changes in pressure over the lifetime of the filter). This historical data can be processed periodically, such as bi-annually to determine if the performance of the system is veering from the expected performance of this vent. The system can flag if the type of filter inserted in the vent is performing outside of expected threshold performances, etc.

A system may be summarized as including an air filter; a first pressure sensor on a first side of the air filter, which in operation reports a first air pressure; a second pressure sensor on a second side of the air filter, which in operation reports a second air pressure; and processing circuitry, coupled to the first pressure sensor and the second pressure sensor, which in operation receives the first air pressure and the second air pressure and determines a pressure difference, filters the pressure difference to determine an average pressure difference, filters the average pressure difference to determine a filter contamination level and communicates a date stamp and the filter contamination level to a local network.

The system may further include an air movement device that moves air through the air filter from the first side of the air filter to the second side of the air filter. The first pressure sensor may include a first opening that faces the air movement device and the second pressure sensor may include a second opening that faces the air movement device.

The system may further include a database, which, in operation, stores the date stamp and the filter contamination level generated by the processing circuitry.

The system may further include a temperature sensor coupled to the processing circuitry.

The system may further include a database, which, in operation, stores the date stamp and the filter contamination level from the processing circuitry; and a data analysis processor coupled to the database, which in operation uses a series of air filter contamination level data to determine a replacement date for the air filter to be replaced with a new air filter. The database may store a type of air filter for which the filter contamination level data is being reported. The air filter may include a center point and the first pressure sensor may be on one side of the center point and the second pressure sensor may be on another side of the center point.

The system may further include an air duct, the air filter being positioned in the air duct, the air filter having a first end opposite a second end, the air duct having a first wall being adjacent to the first end of the air filter and a second wall that faces the first wall, the second wall being adjacent to the second end, the first pressure sensor being closer to the first wall than the second pressure sensor is to the first wall.

The system may further include a support that holds the first pressure sensor and the second pressure sensor, the support being positioned on a first side of the pressure sensor and on a second side of the pressure sensor.

A method may be summarized as including detecting a first pressure with a first sensor on a first side of an air filter; detecting a second pressure with a second sensor on a second side of the air filter; receiving the first and second pressure with processing circuitry from the first and second sensor; determining a pressure difference across the air filter in response to the first and second pressures; determining a median pressure difference by filtering the pressure difference with a low pass filter; determining a filter contamination level by filtering the median pressure difference; transmitting the filter contamination level to a remote database; determining a projected filter replacement date from the filter contamination level using a remote server accessing the filter contamination level from the remote database; and comparing the filter contamination level to a threshold contamination level indicative a time for replacement of the air filter.

The method may further include simulating the contamination level of the air filter using a plurality of filter contamination levels measured for similar air filters that have been in service longer than the air filter.

The method may further include compensating the first pressure and the second pressure for temperature. Filtering the pressure difference may reduce noise from first and second sensor data.

A system may be summarized as including a first sensor assembly, which in operation determines a contamination level of a first air filter; a computing cloud coupled to the first sensor assembly, the computing cloud including: a database, which in operation, stores the contamination level of the first air filter for a plurality of times; and an analytics block which in operation utilizes the contamination level of the first air filter to determine a replacement date for the first air filter; and a maintenance user device, coupled to the computing cloud, which in operation receives the replacement date for the first air filter from the computing cloud.

The database of the computing cloud may further include contamination level data for a second air filter for a second plurality of times.

The computing cloud may further include an artificial intelligence block coupled to the database and the analytics block, the artificial intelligence block in operation utilizing the contamination level data for a second plurality of times for the second air filter to determine the replacement date of the first air filter.

The system may further include a second sensor assembly configured to determine a contamination level of a second filter, the second sensor assembly being coupled to the computing cloud transferring the contamination level of the second filter to the database in the computing cloud.

The present disclosure is directed to a system that is coupled to a ventilation body that houses a filter. A pressure sensor assembly is coupled to the filter and configured to detect a change in pressure from a first side of the filter to a second side of the filter. The pressure sensor assembly could be an absolute pressure sensor or a differential pressure sensor in accordance with embodiments of the present disclosure. Processing circuitry is coupled to the pressure sensor assembly and is configured to collect pressure data from the pressure sensor assembly at a first frequency, such as hourly, daily, bi-weekly, etc. The processing circuitry is configured to generate historical pressure sensor data by analyzing the collected pressure sensor data at a second frequency that is different than the first frequency. For example, the second frequency could be weekly, monthly, or some other maintenance management selected time period. The processing circuitry also is configured to store the historical pressure sensor data and to compare current pressure sensor data with historical pressure sensor data.

In one example, the pressure sensor assembly includes a first substrate on the first side of the filter with a first pressure sensor on the first substrate. A second substrate is spaced from the first substrate and is positioned on the second side of the filter. The first and second sensors are configured to not interfere with the air flow received at the other sensor. For example, the first and second sensors may be on opposites sides of a centerline of the filter. A second pressure sensor is on the second substrate and is electrically coupled to the first substrate, such as with a wire or through a housing. A transceiver is coupled to the first substrate and coupled to the first sensor and to the second sensor.

The processing circuitry coupled to the first substrate, the first pressure sensor, the second pressure sensor, and the transceiver and the processing circuitry is configured to determine a pressure difference between the first pressure sensor and the second pressure sensor. The system may include a temperature sensor and a humidity sensor coupled to at least one of the substrates and configured to provide data to the processing circuitry.

In one embodiment, the ventilation body includes a wall with a first opening on the first side of the filter and a second opening on the second side of the filter and the pressure sensor assembly includes a differential pressure sensor coupled to the first opening and the second opening.

In an alternative embodiment, a system includes a first substrate, a first pressure sensor on the first substrate, a second substrate that is spaced from the first substrate, and a second pressure sensor on the second substrate, the second pressure sensor electrically coupled to the first substrate. A transceiver is coupled to the first substrate and coupled to the first sensor and to the second sensor. An air filter has the first substrate on a first side of the air filter and the second substrate on a second side of the air filter.

The system includes processing circuitry coupled to the first substrate, the first pressure sensor, the second pressure sensor, and the transceiver. The processing circuitry is configured to determine a pressure difference between the first pressure sensor and the second pressure sensor and the processing circuitry is configured to periodically collect the pressure difference between the first pressure sensor and the second pressure sensor at a first frequency, store the pressure difference, and periodically compare the stored pressure differences at a second frequency, the first frequency is more frequent than the second frequency. The processing circuitry is configured to average a plurality of sequentially collected pressure differences between the first pressure sensor and the second pressure sensor to generate a plurality of average pressure differences of the filter and the plurality of average pressure differences are analyzed to determine a threshold reduced pressure difference for the filter. The processing circuitry is configured to compare a current pressure difference with the threshold reduced pressure difference and to generate an interrupt in response to the current pressure difference exceeding the threshold contamination pressure difference.

In another variation, a first ventilation body includes a first filter with a first sensor on a first side of the first filter, the first sensor including a first opening that faces a first direction. A second sensor is on a second side of the first filter, the second sensor including a second opening that faces the first direction, the second sensor being spaced from the first sensor in a second direction that is transverse to the second direction. Processing circuitry is coupled to the first sensor and the second sensor and is configured to collect data from the first sensor and the second sensor at a first period.

A first substrate and a second substrate are physically separate from each other and the first sensor is coupled to the first substrate and the second sensor is coupled to the second substrate. The processing circuitry is coupled to the first substrate and is configured to calculate a plurality of pressure differences. The calculating could include a filtering step that removes anomalies or spikes in data that are considered noise or an abnormality. The processing circuitry is configured to compare ones of the plurality of pressure differences with a performance threshold and generate an interrupt in response to ones of the plurality of pressure differences exceeding the performance threshold.

The comparison step may include averaging a plurality of pressure differences across a time period and then comparing the average pressure difference for the time period with the performance threshold and generating an interrupt in response to the average pressure difference exceeding the threshold performance.

The system includes an maintenance management electronic device that is configured to receive the interrupt from the processing circuitry. A temperature sensor may be coupled to the first substrate and a third substrate that is physically separate from the second substrate, the processing circuitry being coupled to the third substrate, the first substrate including a wireless transceiver configure to transmit the data from the first and second sensor to the processing circuitry. This processing circuitry is configured to calculate a plurality of pressure differences, compare each of the plurality of pressure differences with a threshold performance threshold in light of a current temperature, and generate an interrupt in response to one of the plurality of threshold pressure differences exceeding the threshold performance threshold.

This system can include a second ventilation body, a second filter in the second ventilation body, a third sensor on a first side of the second filter, the third sensor including a third opening that faces a third direction, a fourth sensor on a second side of the second filter, the fourth sensor including a fourth opening that faces the third direction, the fourth sensor being spaced from the third sensor in a fourth direction that is transverse to the third direction, and processing circuitry coupled to the third sensor and the fourth sensor. This processing circuitry may be configured to collect data from the third sensor and the fourth sensor at a second period, determine a first pressure difference between the first and second sensor, and determine a second pressure difference between the third and fourth sensor.

A remote data management device may be included. The processing circuitry being configured to transmit the first pressure difference and the second pressure difference to the remote data management device. The remote data management device may include the processing circuitry. The processing circuitry is configured to compare the first pressure difference and the second pressure difference to a respective filter contamination threshold and to generate an alert in response to the first or second pressure difference exceeding the respective filter contamination threshold.

A remote maintenance server may be included that is configured to receive the alert and activate a notification system for a system maintenance user to visit the first or second filter. The remote maintenance server is configured to store a filter type and filter features for each filter and calculates a replacement date for each filter is in response to the filter type and features. The remote maintenance server is configured to periodically collect the first pressure difference and the second pressure difference, store the first pressure difference with a first time stamp, and store the second pressure difference with a second time stamp, and generate a first historical pressure difference table for the first vent and a second historical pressure difference table for the second vent. The remote maintenance server is configured to compare a recently collected first pressure difference with the first historical pressure difference table and to compare a recently collected second pressure difference with the second historical pressure difference table as part of the calculating of the replacement date. The processing circuitry is configured to collect ventilation health data about the first and second ventilation body by collecting the first pressure difference and the second pressure difference at a first frequency, storing the collected first and second pressure differences with time stamps, and evaluating the stored first and second pressure differences at a second frequency.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A system, comprising:

a ventilation body;

a filter in the ventilation body, the filter having a first side and a second side opposite to the first side;

a fan in the ventilation body, the fan being separated from the filter along a first direction;

a pressure sensor structure coupled to the filter, the pressure sensor structure including:

a first portion having a first height extending along a second direction transverse to the first direction on the first side of the filter, the first portion having a first face that is closer to the fan than a second face;

a second portion having a second height extending along the second direction on the second side of the filter, the second portion having a first face that is closer to the fan than a second face;

wherein the second height is greater than the first height;

a third portion extending along the first direction between the first portion and the second portion, the pressure sensor structure being u-shaped and continuous, wherein the filter slides into the pressure sensor structure between the first portion and the second portion;

a first pressure sensor on the first face of the first portion of the pressure sensor structure, the first pressure sensor having a first opening that faces the fan along the first direction;

a second pressure sensor on the first face of the second portion of the pressure sensor structure, the second pressure sensor having a second opening that faces the fan along the first direction, the second pressure sensor being separated from the first pressure sensor along the second direction that is transverse to the first direction; and processing circuitry coupled to the pressure sensor structure, the processing circuitry: receives collected pressure sensor data including first pressure data from the first pressure sensor and second pressure data from the second pressure sensor at a first frequency, analyzes the collected pressure sensor data at a second frequency that is less than the first frequency to generate historical pressure sensor data, stores the historical pressure sensor data in a memory, generates a threshold reduced pressure difference based on the historical pressure sensor data, identifies a difference between current pressure sensor data of the first and second pressure sensors, and generates an alert in response to the difference exceeding the threshold reduced pressure difference to alert a maintenance user to assess the filter in the ventilation body.

2. The system of claim 1 wherein the pressure sensor structure includes:

a transceiver coupled to the first portion of the pressure sensor structure, and wherein the first pressure sensor is on the first portion of the pressure sensor structure and is coupled to the transceiver, and the second pressure sensor is on the second portion of the pressure sensor structure and is coupled to the transceiver.

3. The system of claim 2 wherein the processing circuitry is coupled to the first portion of the pressure sensor structure, the first pressure sensor, the second pressure sensor, and the transceiver, and the processing circuitry determines the difference between current pressure sensor data collected by the first pressure sensor and the second pressure sensor.

4. The system of claim 1 wherein the ventilation body includes a wall with a first opening on the first side of the filter and a second opening on the second side of the filter.

5. The system of claim 1, wherein the first frequency and the second frequency are selectable.

6. The system of claim 1, wherein the threshold reduced pressure difference is automatically updated over time based on the collected pressure sensor data received by the processing circuitry.

7. A system, comprising:

an air filter including a first side and a second side opposite to the first side along a first direction;

a bracket-shaped pressure sensor structure on the first side and the second side of the air filter, wherein the air filter slides into the pressure sensor structure, the pressure sensor structure including:

a first portion on the first side of the air filter, the first portion having a first height along a second direction transverse to the first direction and a first end; and a second portion spaced from the first portion on the second side of the air filter, the second portion having a second height along the second direction greater than the first height and a second end;

a third portion extending along the first direction between the first portion and the second portion; and a first opening between the first end of the first portion and the second end of the second portion, wherein the air filter slides into the first opening;

a first pressure sensor on the first portion, the first pressure sensor having a first opening pointing along the first direction;

a second pressure sensor on the second portion, the second pressure sensor electrically coupled to the first portion and separated from the first pressure sensor along the second direction, the second pressure sensor having a second opening pointing along the first direction;

a transceiver coupled to the first portion, coupled to the first pressure sensor, and coupled to the second pressure sensor;

a remote maintenance server;

a notification system in communication with the remote maintenance server;

a memory; and processing circuitry in communication with the memory and the remote maintenance server, the processing circuitry stores data of pressure differences between first pressure data collected by the first pressure sensor and second pressure data collected by the second pressure sensor at a first frequency, compares the data of pressure differences to a threshold reduced pressure difference at a second frequency less than the first frequency, generates an interrupt signal in response to the data of pressure differences between the first pressure sensor and the second pressure sensor exceeding the threshold reduced pressure difference, outputs the interrupt signal to the remote maintenance server, and, in response to the interrupt signal, the remote maintenance server activates the notification system to alert a system maintenance user to assess the air filter.

8. The system of claim 7 wherein the processing circuitry is coupled to the first portion, the first pressure sensor, the second pressure sensor, and the transceiver.

9. The system of claim 8 wherein the processing circuitry determines the pressure difference between the first pressure data and the second pressure data.

10. The system of claim 8 wherein the processing circuitry is configured to average a plurality of sequentially collected respective pressure differences of the data of pressure differences between the first pressure sensor and the second pressure sensor to generate a plurality of average pressure differences of the air filter, and the plurality of average pressure differences are analyzed by the processing circuitry to determine the threshold reduced pressure difference for the filter.

11. The system of claim 10 wherein the processing circuitry comparing the data of pressure differences to the threshold reduced pressure difference at the second frequency includes comparing a current pressure difference of the data of pressure differences with the threshold reduced pressure difference, and, in response to the current pressure difference of the data of pressure differences exceeding the threshold reduced pressure difference, the processing circuitry generates the interrupt signal.

12. The system of claim 7, wherein the first frequency and the second frequency are selectable.

13. The system of claim 7, wherein the threshold reduced pressure difference is automatically updated over time based on the collected pressure sensor data received by the processing circuitry.

14. A system, comprising:

a first ventilation body having a first wall and a second wall;

a first filter in the first ventilation body, the first filter including a first side and a second side opposite to the first side along a first direction;

a u-shaped air filter frame extending entirely from the first wall to the second wall of the ventilation body along a second direction transverse to the first direction, wherein the air filter slides along the second direction into the air filter frame, the air filter frame comprising:

a first portion having a first height extending along the second direction on the first side of the air filter;

a second portion having a second height extending along the second direction on the second side of the air filter;

wherein the second height is greater than the first height;

a third portion extending along the first direction between the first portion and the second portion;

a u-shaped pressure sensor support, including a first portion having the first height coupled to the first portion of the air filter frame, a second portion having the second height coupled to the second portion of the air filter frame, and a third portion coupled to the third portion of the air filter frame;

a first pressure sensor coupled to the first portion of the pressure sensor support, the first pressure sensor having a first opening pointing along the first direction;

a second pressure sensor on the second portion of the pressure sensor support, the second pressure sensor being spaced from the first pressure sensor by the first filter and being offset from the first pressure sensor along the second direction, the second pressure sensor having a second opening pointing along the first direction;

at least one processing circuitry coupled to the first pressure sensor and the second pressure sensor, the processing circuitry including at least one memory, the at least one processing circuitry determines and stores data of first pressure differences between the first pressure sensor and the second pressure sensor at a first frequency on the at least one memory, compares the first pressure differences between the first pressure sensor and the second pressure sensor to a first filter contamination threshold at a second frequency less than the first frequency, and, in response to the first pressure differences exceeding the first filter contamination threshold, generates a first alert; and in response to the first pressure differences exceeding the first filter contamination threshold, a remote maintenance server receives the first alert and activates a notification system for a system maintenance user to assess the first filter.

15. The system of claim 14 wherein the processing circuitry is coupled to the pressure sensor support, and the processing circuitry calculates the first pressure differences.

16. The system of claim 15 further comprising:

a remote electronic device that is configured to receive an interrupt signal from the processing circuitry.

17. The system of claim 14 further comprising:

a temperature sensor coupled to the first portion of the pressure sensor support, wherein the processing circuitry is coupled to the third portion of the pressure sensor support, the first portion of the pressure sensor support including a wireless transceiver configured to transmit the data from the first and second pressure sensors to the processing circuitry.

18. The system of claim 14 further comprising:

a second ventilation body;

a second filter in the second ventilation body, the second filter having a first side and a second side opposite to the first side;

a third sensor on the first side of the second filter;

a fourth sensor on the second side of the second filter, the fourth sensor being spaced from the third sensor by the second filter and being offset from the third sensor; and wherein the at least one processing circuitry is coupled to the third sensor and the fourth sensor, the at least one processing circuitry determines and stores data of second pressure differences between the third sensor and the fourth sensor at the first frequency on the at least one memory.

19. The system of claim 18 wherein:

the at least one processing circuitry compares the second pressure differences to a second filter contamination threshold;

in response to the second pressure differences exceeding the second filter contamination threshold, the at least one processing circuitry generates a second alert; and in response to the second pressure differences exceeding the second filter contamination threshold, the remote maintenance server receives the second alert and activates the notification system for the system maintenance user to assess the second filter.

20. The system of claim 18 wherein the remote maintenance server is configured to store a filter type and filter features for the first filter and the second filter, respectively, and the remote maintenance server calculates a replacement date for the first filter and the second filter in response to the filter type and filter features for the first filter and the second filter, respectively.

21. The system of claim 20 wherein the remote maintenance server is configured to periodically collect at least one of the first pressure differences and at least one of the second pressure differences, store the at least one of the first pressure differences with a first time stamp, and store the at least one of the second pressure differences with a second time stamp, and generate a first historical pressure difference table for the first ventilation body and a second historical pressure difference table for the second ventilation body.

22. The system of claim 21 wherein the remote maintenance server is configured to compare a recently collected respective first pressure difference of the first pressure differences with the first historical pressure difference table and to compare a recently collected respective second pressure difference of the second pressure differences with the second historical pressure difference table in calculating of the replacement date.

23. The system of claim 14, wherein the first frequency and the second frequency are selectable.

* * * * *